US011053071B2

(12) United States Patent
Hodge

(10) Patent No.: US 11,053,071 B2
(45) Date of Patent: Jul. 6, 2021

(54) LID LOCKING APPARATUS AND METHOD FOR TRASH CONTAINER

(71) Applicant: Hodge Products, Inc., San Diego, CA (US)

(72) Inventor: Anthony A. Hodge, Santee, CA (US)

(73) Assignee: Hodge Products, Inc., San Diego, CA (US)

( * ) Notice: Subject to any disclaimer, the term of this patent is extended or adjusted under 35 U.S.C. 154(b) by 96 days.

(21) Appl. No.: 16/550,067

(22) Filed: Aug. 23, 2019

(65) Prior Publication Data

US 2019/0382201 A1 Dec. 19, 2019

Related U.S. Application Data

(63) Continuation-in-part of application No. 16/059,968, filed on Aug. 9, 2018, which is a continuation-in-part of application No. 15/678,949, filed on Aug. 16, 2017, now abandoned.

(51) Int. Cl.

| | |
|---|---|
| ***B65F 1/16*** | (2006.01) |
| ***E05B 67/38*** | (2006.01) |
| *E05B 63/04* | (2006.01) |

(52) U.S. Cl.
CPC ..... *B65F 1/1615* (2013.01); *E05B 67/383* (2013.01); *E05B 63/04* (2013.01); *Y10T 292/23* (2015.04)

(58) Field of Classification Search
CPC ..... E05B 67/383; E05B 2067/386; E05B 63/0052; Y10T 292/34; Y10T 292/37; Y10T 292/283; Y10T 292/1086; Y10T 292/397; Y10T 292/23; Y10S 292/25
See application file for complete search history.

(56) References Cited

U.S. PATENT DOCUMENTS

| | | | | |
|---|---|---|---|---|
| 334,840 | A | 1/1886 | Bernard | |
| 351,252 | A | 10/1886 | Dare | |
| 353,088 | A | 11/1886 | Shopman | |
| 550,546 | A | 11/1895 | Clinton | |
| 739,640 | A | 9/1903 | Beehler | |
| 878,047 | A | 2/1908 | Darracott | |
| 2,156,355 | A * | 5/1939 | Sandberg | B60R 25/066 70/193 |
| 2,198,079 | A | 4/1940 | Ferris et al. | |
| 2,223,876 | A * | 12/1940 | Scanlan | E05C 3/30 70/91 |
| 2,517,185 | A | 8/1950 | Elmer | |

(Continued)

*Primary Examiner* — Carlos Lugo
(74) *Attorney, Agent, or Firm* — Procopio Cory Hargreaves and Savitch LLP

(57) ABSTRACT

A trash container lid locking apparatus comprises a pivot device including a mounting plate configured to be secured to a side edge of a trash container close to a front of the container, a pivot arm having a first end pivotally coupled to the mounting plate and a second end, the second end having an attachment portion to couple to an elongated bar which is longer than the front of the trash container, the pivot arm including a hole therein, and a housing including a rotating lock mechanism having a movable element that is operable by the rotating lock mechanism into and out of the hole of the pivot arm to lock and unlock the pivot arm and bar with respect to the hinged container lid of the trash container.

8 Claims, 26 Drawing Sheets

(56) References Cited

U.S. PATENT DOCUMENTS 2,938,373 A * 5/1960 Gray ..... E05B 63/0017 70/86
3,740,978 A * 6/1973 Smith ..... E05B 65/0811 70/100
3,893,722 A * 7/1975 Galbreath ..... E05B 13/002 292/100
3,930,388 A * 1/1976 Barras ..... B60K 15/05 70/159
4,058,994 A * 11/1977 Coppola ..... E05B 73/0076 70/232
4,196,602 A * 4/1980 Akselsen ..... E05B 13/002 292/207
4,198,083 A 4/1980 Fessler
4,577,563 A * 3/1986 Sidler ..... E05G 1/005 109/52
4,581,907 A * 4/1986 Eberly ..... E05B 67/38 292/205
4,584,856 A * 4/1986 Petersdorff ..... E05B 17/142 379/445
4,593,541 A * 6/1986 Hollis ..... E05B 73/00 174/67
4,694,667 A 9/1987 Hodge
4,823,571 A * 4/1989 O'Gara ..... E05B 9/084 70/139
4,898,009 A * 2/1990 Lakoski ..... E05B 73/00 439/133
5,029,724 A 7/1991 Serio
5,104,163 A 4/1992 Palmer, Jr. et al.
5,170,907 A * 12/1992 Sakai ..... A45C 13/18 109/52
5,224,743 A 7/1993 Dawdy et al.
5,683,126 A 11/1997 De Vivo et al.
6,170,304 B1 * 1/2001 Ohta ..... E05B 67/36 70/14
6,733,053 B2 5/2004 Hodge et al.
6,772,613 B2 * 8/2004 Webb ..... B25H 3/02 292/148
7,597,365 B2 10/2009 Kreitzer
7,726,751 B2 * 6/2010 Bergmann ..... E05C 3/042 312/222
7,810,854 B2 10/2010 Hodge et al.
8,136,852 B1 3/2012 Thomas
8,313,126 B2 11/2012 Ferkovich et al.
8,935,944 B2 1/2015 Boesel et al.
9,580,243 B2 2/2017 Reeb
9,926,725 B2 * 3/2018 AbuGhazaleh ..... H05K 7/186

* cited by examiner

LID LOCKING APPARATUS AND METHOD FOR TRASH CONTAINER

CROSS REFERENCE TO RELATED APPLICATIONS

This application is a continuation-in-part of U.S. patent application Ser. No. 16/059,968, filed Aug. 9, 2018, which is a continuation-in-part of U.S. patent application Ser. No. 15/678,949, filed Aug. 16, 2017. All of the above-referenced applications are incorporated by reference herein.

BACKGROUND

Related Field

The subject matter discussed herein relates generally to locking apparatus and methods for locking the hinged or removable lids of commercial or large size trash containers or bins/dumpsters by means of a pivoted, lockable bar extending over the lid in the closed position.

Related Background

Many trash container locking systems are known in which a bar is attached to pivot arms on opposite sides of a trash container for movement between an unlocked position across the front of the container in which the lid can be freely opened and closed, and a locked position extending over the top of the closed lid so it cannot be opened. A locking mechanism is provided to lock one of the arms in place when the bar extends across the top of the lid. Such systems are described, for example, in U.S. Pat. No. 5,029,724 of Serio, U.S. Pat. No. 5,213,382 of Dawdy, and U.S. Pat. Nos. 6,733,053 and 8,313,126 of Hodge Products, Inc. A lid locking system sold by HPI (Hodge Products, Inc.) comprises two pivot arms pivotally mounted on base plates for securing to opposite sides of the trash container, and a separate lock plate to be mounted on one side of the container so that an opening in the pivot arm on that side is aligned with a hole in the lock plate or hasp in the locked position of the bar. Installation and proper alignment of the parts of this system may be difficult in some cases.

SUMMARY

According to one aspect, a lid locking apparatus for a trash container comprises first and second pivot devices each having a mounting plate configured to be secured to a respective side edge of the trash container close to the front of the container and respective first and second pivot arms each having a first end pivotally mounted to the respective first and mounting plate and a second end adapted for connection to a respective end of an elongate pipe or bar which is longer than the front end of the trash container. The first pivot device is lockable and the first pivot arm has opposite side edges and an outwardly projecting locking flange on one side edge which has at least one slot or opening. The mounting plate of the first pivot device has a stop plate or padlock hasp extending outwardly from a side edge of the base plate in the same direction as the locking flange. The stop plate also has at least one slot or opening. When the mounting plates are secured by welding, bolting, or the like to opposite sides of a trash container and a bar is secured between second ends of the pivot arms, the arms are rotatable between an unlocked position in which the bar extends across the front of the container and the hinged container lid can be freely opened and closed, and a locked position in which the bar and arms are pivoted upward and rearward so that the bar extends over the top of the container lid. The stop plate on the mounting plate and locking flange on the first pivot arm are positioned and oriented such that the locking flange is adjacent to the stop plate in the locking position with at least part of the opening in the locking flange aligned with an opening in the stop plate. A padlock shackle is engaged through the aligned openings to secure the bar in the locked position, preventing unauthorized dumping of trash in the container.

In one embodiment, the openings in the locking flange and stop plate each comprise an elongated slot for ease in alignment, but in alternative embodiments one of these parts may have a single circular opening or more than one circular opening while the other has an elongated slot. In one embodiment, the locking flange is positioned such that it is in face-to-face engagement with the stop plate in the locking position. In some embodiments, an indent is provided on one edge of the stop plate to act as a welding or attachment point for the chain of a padlock, so that the padlock can be permanently attached to the lockable pivot device and ready for engagement with the aligned openings or slots in the locking flange and stop plate to lock these parts together and prevent access to the container.

According to another aspect, a method of locking a trash container lid in a closed position comprises mounting first and second pivot mounting plates on opposite side rims of a trash container adjacent to the front wall and upper end opening of the container; securing a locking bar between second ends of first and second pivot arms which have respective first ends pivotally mounted on the respective first and second pivot mounting plates; positioning the pivot arms in a first, unlocked position in which the locking bar extends across the front wall of the container; closing the lid of the container; rotating the first and second pivot arms in a first, locking direction upwards and rearwards until the locking bar extends across the closed lid of the container and a locking flange on the first pivot arm engages a stop plate on the first mounting plate which projects outwards from the first mounting plate and respective side rim of the container to prevent further movement of the pivot arms in the first, locking direction; and engaging the shackle of a padlock through aligned openings in the stop plate and locking flange and locking the shackle to the padlock body to retain the first and second pivot arms and locking bar in the locked position.

According to an additional aspect, a trash container lid locking apparatus comprises first and second pivot devices; the first pivot device comprising a first mounting plate configured to be secured to a first side edge of a trash container close to the front of the container and having a front face configured to face outwards from the side edge when installed, and a first pivot arm having a first end pivotally mounted on the first mounting plate and a second end, the second end having an attachment portion for attachment to a first end of an elongated bar which is longer than the front of the trash container; the second pivot device comprising a second mounting plate configured to be secured to a second side edge of the trash container and a second pivot arm having a first end pivotally mounted on the second mounting plate and a second end, the second end of the second pivot arm having an attachment portion for attachment to a second end of the elongated bar; the first pivot arm having opposite side edges and an element operable with a rotating lock mechanism; and a stop plate extending outwards from the first mounting plate, the stop plate having a rotating lock mechanism; whereby the first and second pivot arms are rotatable between an unlocked position in which the bar extends across the front of the container and the hinged container lid can be freely opened and closed, and a locking position in which the bar and arms are pivoted upward and rearward so that the bar extends over the top of the container lid; and wherein the element operable with a rotating lock mechanism is configured to be positioned adjacent the rotating lock mechanism so that the rotating lock mechanism can be locked to the element when the first pivot arm is in the locking position.

One or more implementations of the aspect of the invention described immediately above includes one or more of the following: the element operable with a rotating lock mechanism includes an elongated slot and the rotating lock mechanism is a key-operated cam lock mechanism including a cam that is operable with respect to the elongated slot so that the rotating lock mechanism can be locked to the element; the element includes a housing that that receives and protects the cam to prevent tampering with the cam; the rotating lock mechanism includes a key-operated cam lock mechanism and a combination lock; the rotating lock mechanism is combination lock; the combination lock includes a combination-controlled cam lock mechanism; and/or the rotating lock mechanism includes a cam lock mechanism and a padlock securable to the cam lock mechanism to prevent rotation of the cam lock mechanism.

According to a further aspect, a method of locking a trash container lid in a closed position comprises mounting first and second pivot mounting plates on opposite side rims of a trash container adjacent the front wall and upper end opening of the container; securing a locking bar between second ends of first and second pivot arms, the first and second pivot arms having respective first ends pivotally mounted on the respective first and second pivot mounting plates; positioning the pivot arms in a first, unlocked position in which the locking bar extends across the front wall of the container; closing the lid of the container; rotating the first and second pivot arms in a first, locking direction upwards and rearwards into a locking position; locking the first and second pivot arms and locking bar in the locked position in which the locking bar extends across the closed lid of the container by causing a rotating lock mechanism of the stop plate on the first mounting plate which projects outwards from the first mounting plate and respective side rim of the container to operably engage an element of the first pivot arm, wherein operable engagement between the rotating lock mechanism and the element of the first pivot arm retains the first and second pivot arms and locking bar in the locked position.

According to a still further aspect, a trash container lid locking apparatus comprises first and second pivot devices; the first pivot device comprising a first mounting plate configured to be secured to a first side edge of a trash container close to the front of the container and having a front face configured to face outwards from the side edge when installed, and a first pivot arm having a first end pivotally mounted on the first mounting plate and a second end, the second end having an attachment portion for attachment to a first end of an elongated bar which is longer than the front of the trash container; the second pivot device comprising a second mounting plate configured to be secured to a second side edge of the trash container and a second pivot arm having a first end pivotally mounted on the second mounting plate and a second end, the second end of the second pivot arm having an attachment portion for attachment to a second end of the elongated bar; the first pivot arm having opposite side edges and an element operable with an electronic lock mechanism; and a stop plate extending outwards from the first mounting plate, the stop plate having an electronic lock mechanism; whereby the first and second pivot arms are rotatable between an unlocked position in which the bar extends across the front of the container and the hinged container lid can be freely opened and closed, and a locking position in which the bar and arms are pivoted upward and rearward so that the bar extends over the top of the container lid; and wherein the element operable with an electronic lock mechanism is configured to be positioned adjacent the electronic lock mechanism so that the electronic lock mechanism can be locked to the element when the first pivot arm is in the locking position, the electronic lock mechanism controlled by one or more modules on a wireless mobile electronic computing device to control the locking and unlocking of the electronic lock mechanism. In one or more embodiments, other devices such as, but not limited to, key frequency operated button ("FOB")/FOB pad, RFID, infrared device/chip/sensor, may be used or associated with the electronic lock mechanism to lock/unlock the electronic locking mechanism. In further embodiments, the wireless mobile electronic computing device (or other wireless device) communicates with the electronic lock mechanism via Bluetooth® (a registered mark of Bluetooth Sig, Inc. of Kirkland, Wash.) wireless connection or other wireless connection.

According to an additional aspect, a method of locking a trash container lid in a closed position comprises mounting first and second pivot mounting plates on opposite side rims of a trash container adjacent the front wall and upper end opening of the container; securing a locking bar between second ends of first and second pivot arms, the first and second pivot arms having respective first ends pivotally mounted on the respective first and second pivot mounting plates; positioning the pivot arms in a first, unlocked position in which the locking bar extends across the front wall of the container; closing the lid of the container; rotating the first and second pivot arms in a first, locking direction upwards and rearwards into a locking position in which the locking bar extends across the closed lid of the container; locking the first and second pivot arms and locking bar in the locked position in which the locking bar extends across the closed lid of the container by causing an electronic lock mechanism of the stop plate on the first mounting plate which projects outwards from the first mounting plate and respective side rim of the container to operably engage an element of the first pivot arm, wherein operable engagement between the electronic lock mechanism and the element of the first pivot arm to retain the first and second pivot arms and locking bar in the locked position is controlled by one or more modules on a wireless mobile electronic computing device to control the locking and unlocking of the electronic lock mechanism.

A still further aspect of the invention involves a lid locking apparatus having one or more of the different types of lock mechanisms shown and/or described herein including, but not limited to a key-operated lock mechanism, a padlock lock mechanism, a combination lock mechanism, and electronic locking mechanism (e.g., actuated by RFID/sensor, wireless mobile electronic computing device via Bluetooth® wireless connection or other wireless connection, FOB).

Another aspect of the invention involves a trash container lid locking apparatus, comprising a pivot device comprising a mounting plate configured to be secured to a side edge of a trash container close to a front of the container, a pivot arm having a first end pivotally coupled to the mounting plate and a second end, the second end having an attachment portion to couple to an elongated bar which is longer than the front of the trash container, the pivot arm including a hole therein, and a housing including a rotating lock mechanism having a movable element that is operable by the rotating lock mechanism; whereby the pivot arm is rotatable between an unlocked position in which the bar extends across the front of the container and the hinged container lid can be freely opened and closed, and a locked position in which the bar and pivot arm are pivoted upward and rearward so that the bar extends over the top of the container lid; and wherein the movable element operable with the rotating lock mechanism is configured to be positioned through the hole in the pivot arm to lock the pivot arm in the locked position and removed from the hole in the pivot arm to unlock the pivot arm so that the pivot arm can be moved to the unlocked position.

One or more implementations of the aspect of the invention described immediately above includes one or more of the following: the hole in the pivot arm is an elongated slot that the movable element of the rotating lock mechanism is positioned through to lock the pivot arm in the locked position; the housing receives and protects the movable element to prevent tampering with the movable element; the rotating lock mechanism is a key-operated cam lock mechanism; the rotating lock mechanism is combination lock; the combination lock includes a combination-controlled cam lock mechanism; and/or the pivot device includes a bracket coupled to the mounting plate, the bracket includes a hole therein, and the movable element operable with the rotating lock mechanism is configured to be positioned through the hole in the pivot arm and the hole in the bracket to lock the pivot arm in the locked position and removed from the hole in the pivot arm and the hole in the bracket to unlock the pivot arm so that the pivot arm can be moved to the unlocked position.

A further aspect of the invention involves a method of locking a trash container lid in a closed position with the trash container lid locking apparatus of the aspect of the invention described immediately above. The method comprises mounting the pivot mounting plate on the side edge of the trash container adjacent to the front and an upper end opening of the trash container; coupling the locking bar to the second end of the pivot arm; positioning the pivot arm in the unlocked position in which the locking bar extends across the front of the container; closing the lid of the container; rotating the pivot arm in a direction upwards and rearwards into the locked position; locking the pivot arm and the locking bar in the locked position in which the locking bar extends across the closed lid of the container by causing the movable element operable with the rotating lock mechanism to be positioned through the hole in the pivot arm to lock the pivot arm in the locking position.

Other features and advantages of the present invention will become more readily apparent to those of ordinary skill in the art after reviewing the following detailed description and accompanying drawings.

DETAILED DESCRIPTION

The subject matter described herein is taught by way of example implementations. Various details have been omitted for the sake of clarity and to avoid obscuring the subject matter. The examples shown below are directed to devices, apparatus and methods for locking the lid of a commercial trash container (e.g., cubic yard sizes 1, 2, 3, 4, 5, 6) in the closed position. Other features and advantages of the subject matter should be apparent from the following description.

After reading this description it will become apparent to one skilled in the art how to implement the invention in various alternative embodiments and alternative applications. However, all the various embodiments of the present invention will not be described herein. It is understood that the embodiments presented here are presented by way of an example only, and not limitation.

Figure 1:
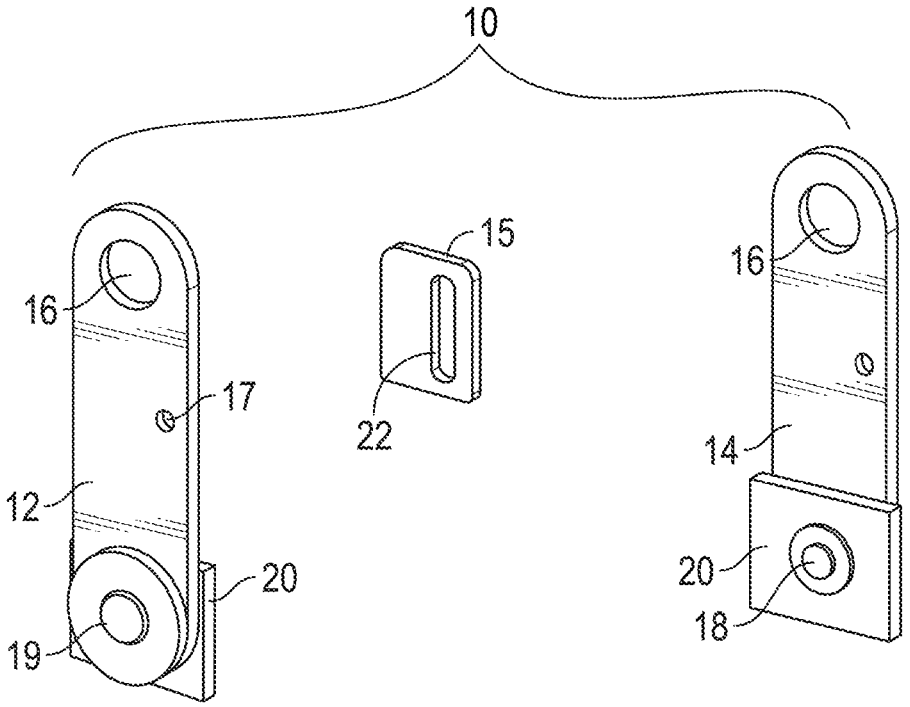
FIG. 1 (Prior Art)
FIG. 1 is a perspective view of the separated parts of a prior art trash container lid locking apparatus.
Figure 2:
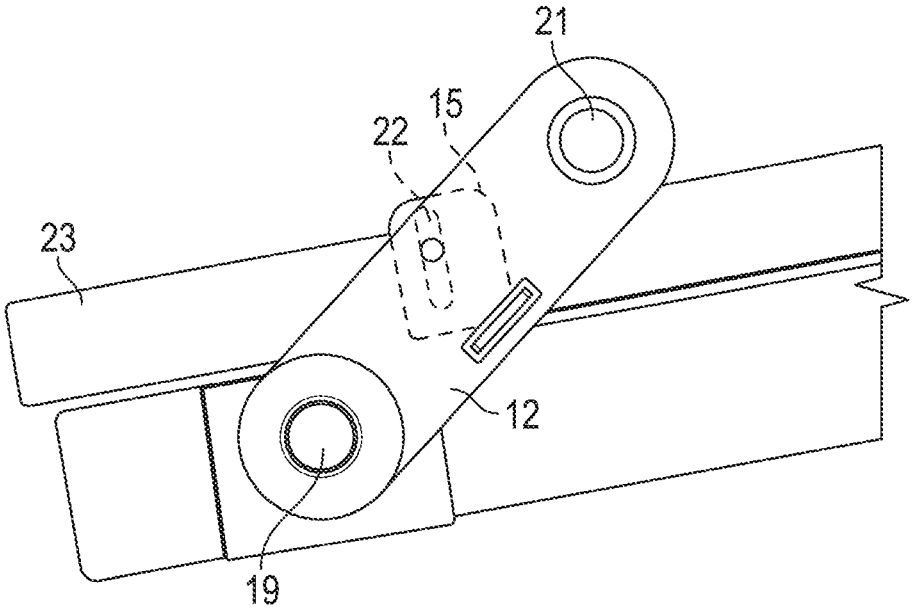
FIG. 2 (Prior Art)
FIG. 2 is a side elevation view of the prior art apparatus of FIG. 1, illustrating one of the arms and the padlock hasp secured to one side of a trash container, in the lid locking position.

FIGS. 1 and 2 illustrate a prior art container lid locking apparatus or kit 10 which is sold by Hodge Products, Inc. (HPI). Apparatus 10 basically comprises left and right pivot devices 12, 14 and a separate locking plate or padlock hasp 15. FIG. 1 illustrates the front face of pivot device 12 and the rear face of pivot device 14. Each pivot device 12, 14 comprises an elongated plate or pivot arm with an opening 16 at one end and a small lock opening 17 on one side. The opposite end is rotatably secured to pivot pin 18 extending from pivot mounting plate 20 through an opening in the respective arm and having a head 19 at its outer end. The mounting plates 20 of the respective arms are secured in the same position on opposite sides of a trash container, bin, or dumpster (hereinafter "trash container"), and a pipe or bar 21 is secured between the free ends of the arms so as to be pivotable from a position extending across the front of the container to a locking position rotated upwards and rearwards to extend over the top of the closed lid 23, as seen in FIG. 2. The pipe or bar (hereinafter "bar") 21 is an elongate pipe or bar, (e.g., typically schedule 40 pipe with 1" o.d. —¾" i.d.). The lid locking apparatus may be welded to opposite side of a metal trash container and bolted to opposite sides of a plastic trash container. The separate locking plate 15 has a slot 22 and is secured to one side of the container (the left hand side in this case) at a position in which the lock opening 17 in the pivot arm 12 on that side is aligned with the slot 22 in the locking plate or hasp when the pipe 21 is in the locking position, as seen in FIG. 2. A shackle of a padlock (not illustrated), which is attached to the pivot mounting plate 20 via a chain (not shown), both of which come with the apparatus 10, is then secured through the aligned opening and slot and locked to secure the bar in the locked position, so that the container lid cannot be opened. One problem with this arrangement is that it can be difficult to position the locking plate 15 on installation so that opening 17 is aligned with slot 22 in the locking position.

Figure 3:
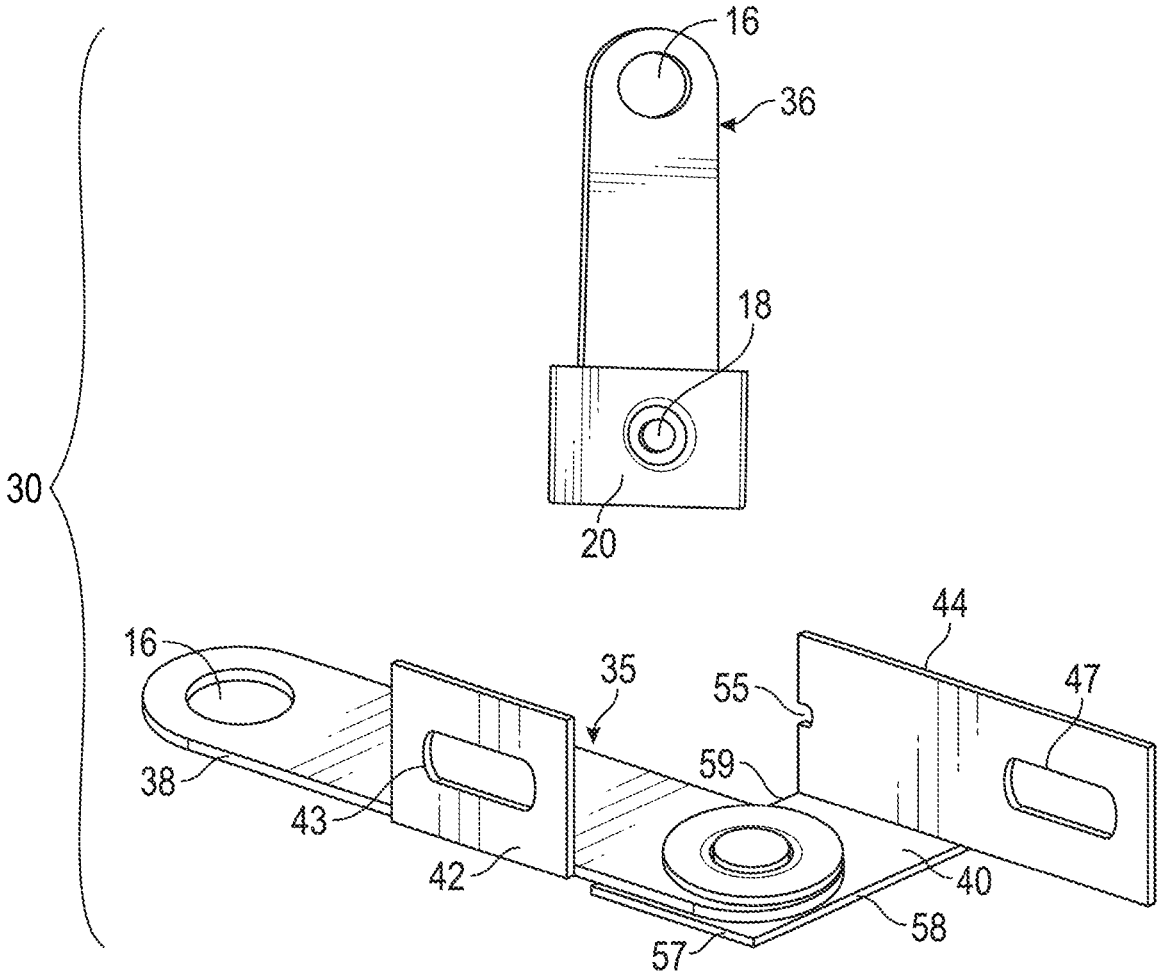
FIG. 3 is a perspective view illustrating the separated parts or pivot devices of one embodiment of a lid locking apparatus for a trash container.
Figure 8:
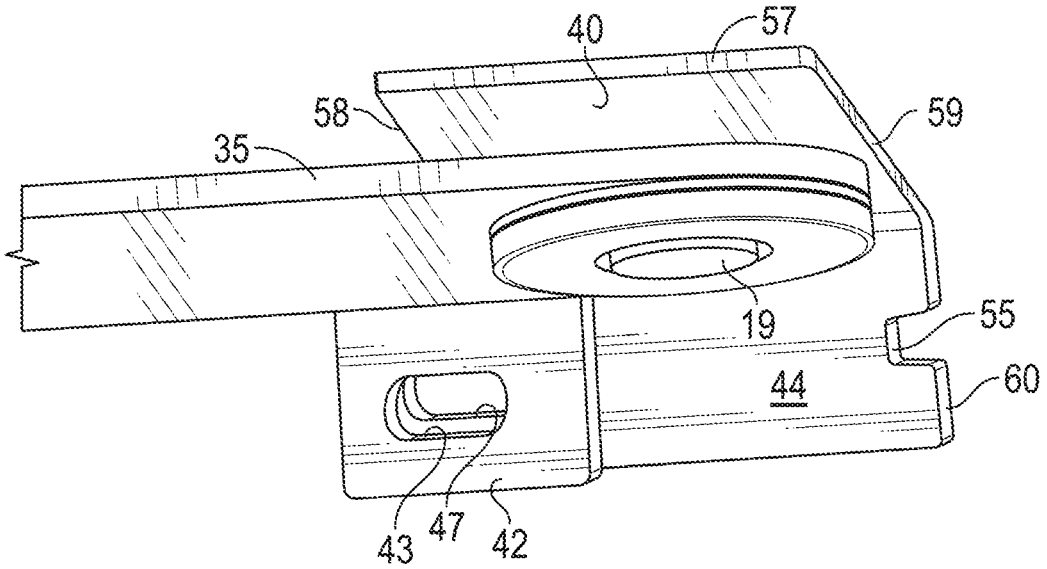
FIG. 8 is side view of the locking pivot device in the position of FIG. 7 without a chain and padlock shown.
Figure 9A:
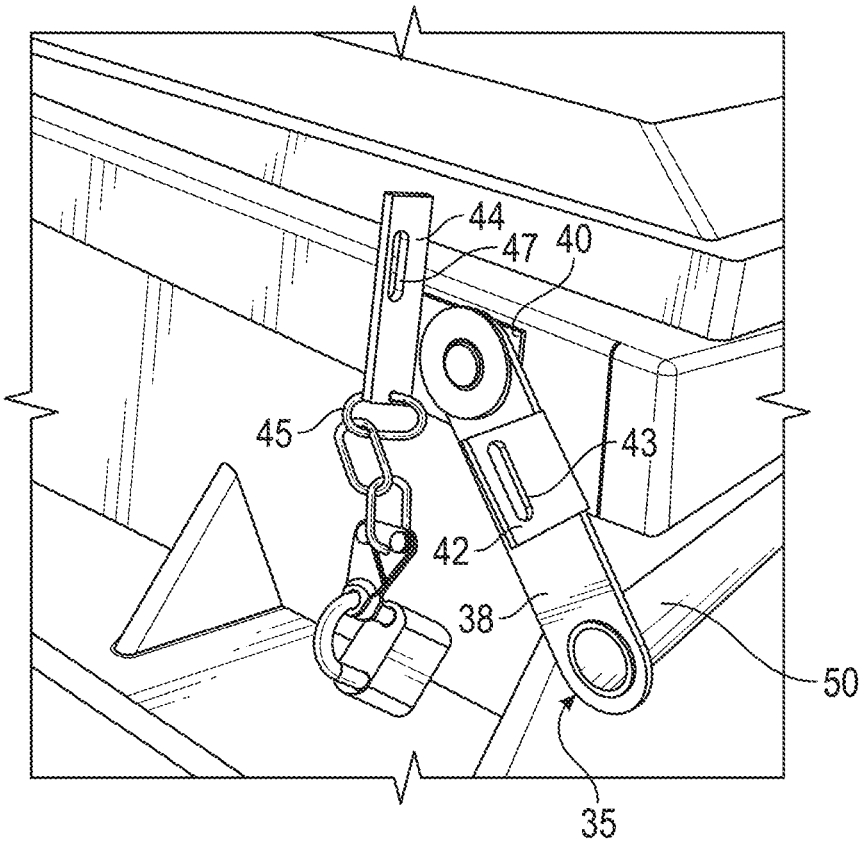
FIG. 9A is a perspective, broken away view of the top portion of a trash container with the arms of the lid locking apparatus pivotally secured on opposite sides of the container and a bar secured between the free ends of the arms, in the unlocked position.
Figure 9B:
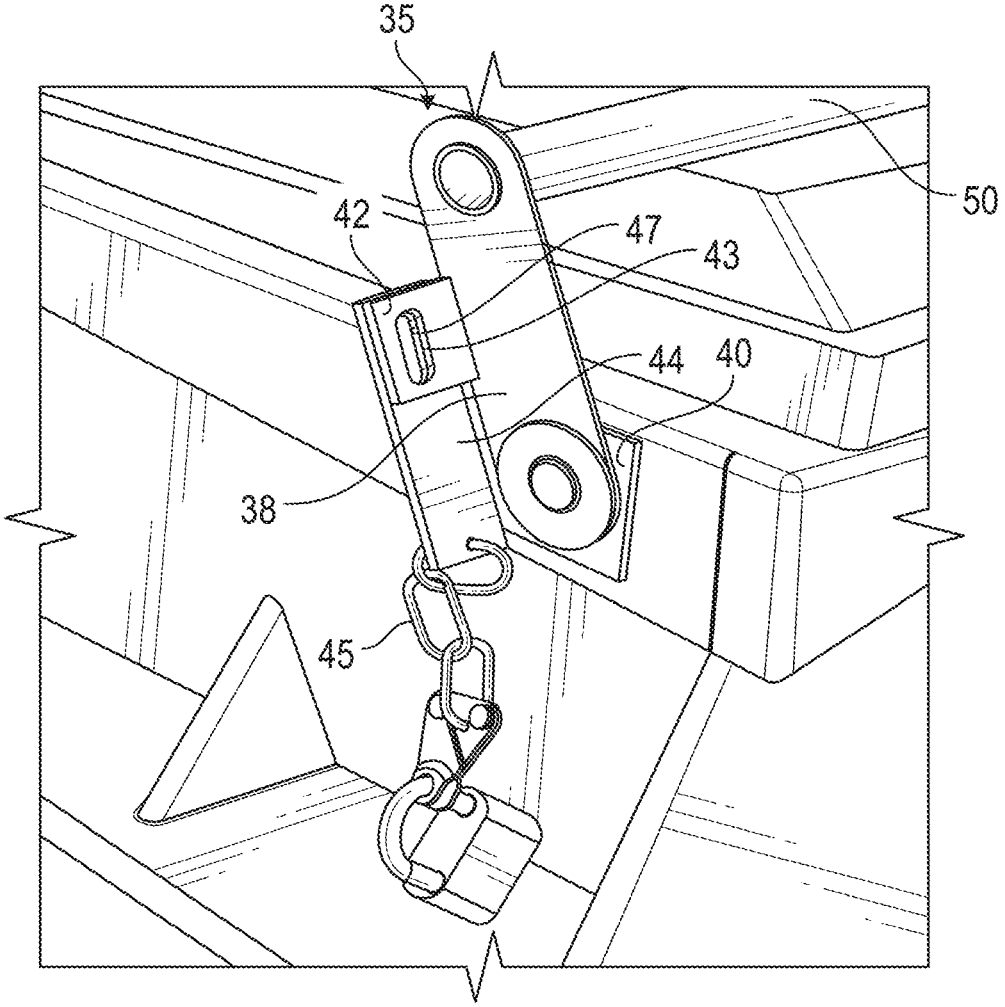
FIG. 9B is a perspective, broken away view of the top portion of a trash container similar to FIG. 9A, but shows that mounting plate and stop plate may be positioned in any way/angle the installer chooses, and not necessarily in a vertical orientation.
Figure 10:
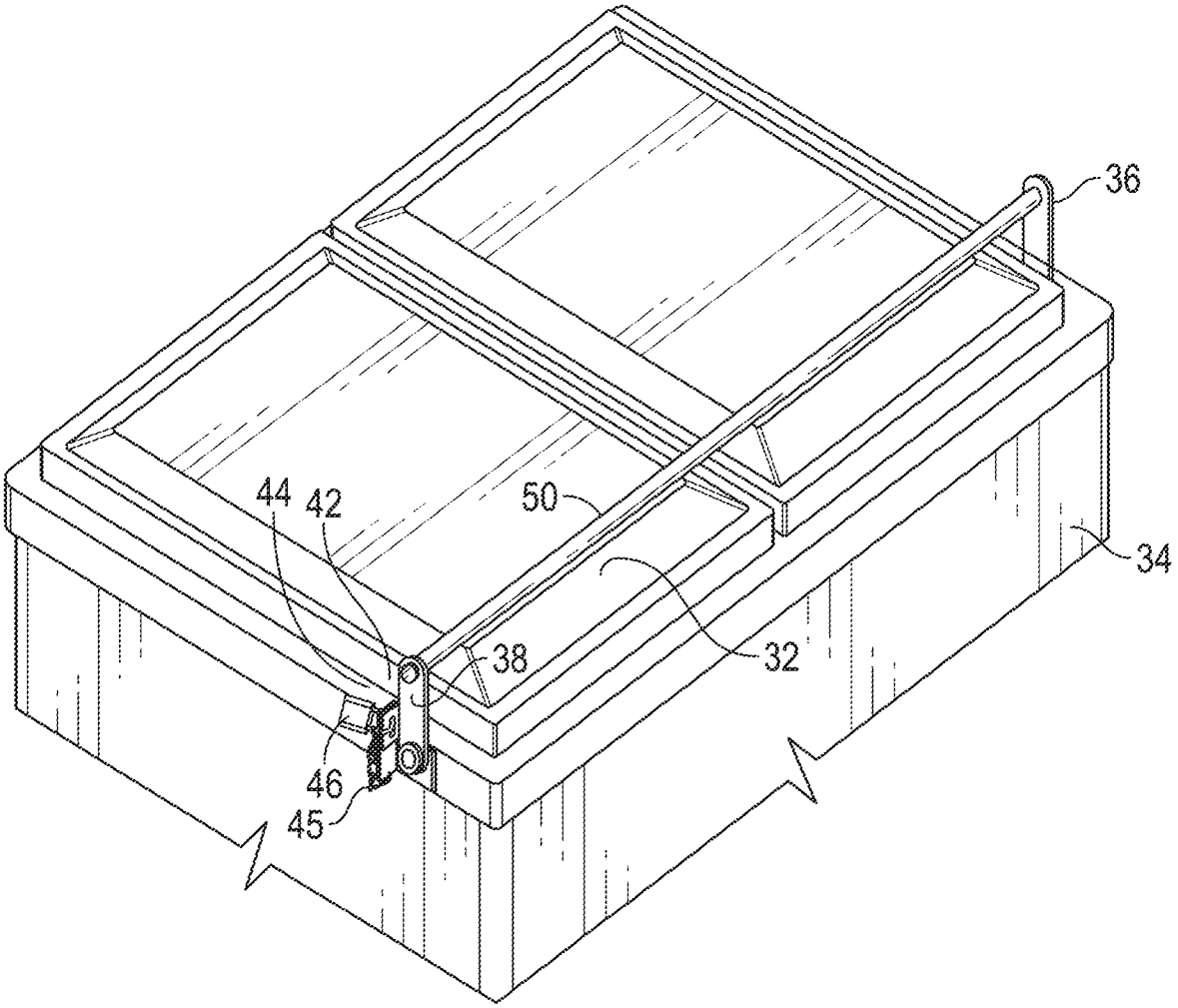
FIG. 10 is a view similar to FIG. 9 but illustrating the bar pivoted upwards and rearwards over the top of the container lid and the lockable pivot arm in the locking position with the locking flange engaging the stop plate and secured by a padlock shackle extending through the aligned slots in the locking flange and stop plate, as in FIG. 7.

FIGS. 3 to 10 illustrate an embodiment of a lid lock apparatus 30 for locking a hinged lid 32 of a trash container 34 in a closed position (see FIG. 10). The apparatus 30 basically comprises a first, locking pivot device 35 and a second pivot device 36 which is not lockable. FIG. 3 illustrates the front of the first pivot device 35 and the rear of the second pivot device 36. In one embodiment, the second pivot device is similar or identical to the pivot devices 12, 14 of the prior art apparatus illustrated in FIG. 1, and like reference numbers have been used for like parts as appropriate. In the illustrated embodiment, the locking pivot device 35 is designed for installation on the left hand side of a trash container, but it could alternatively be designed for installation on the right hand side.

Figure 4:
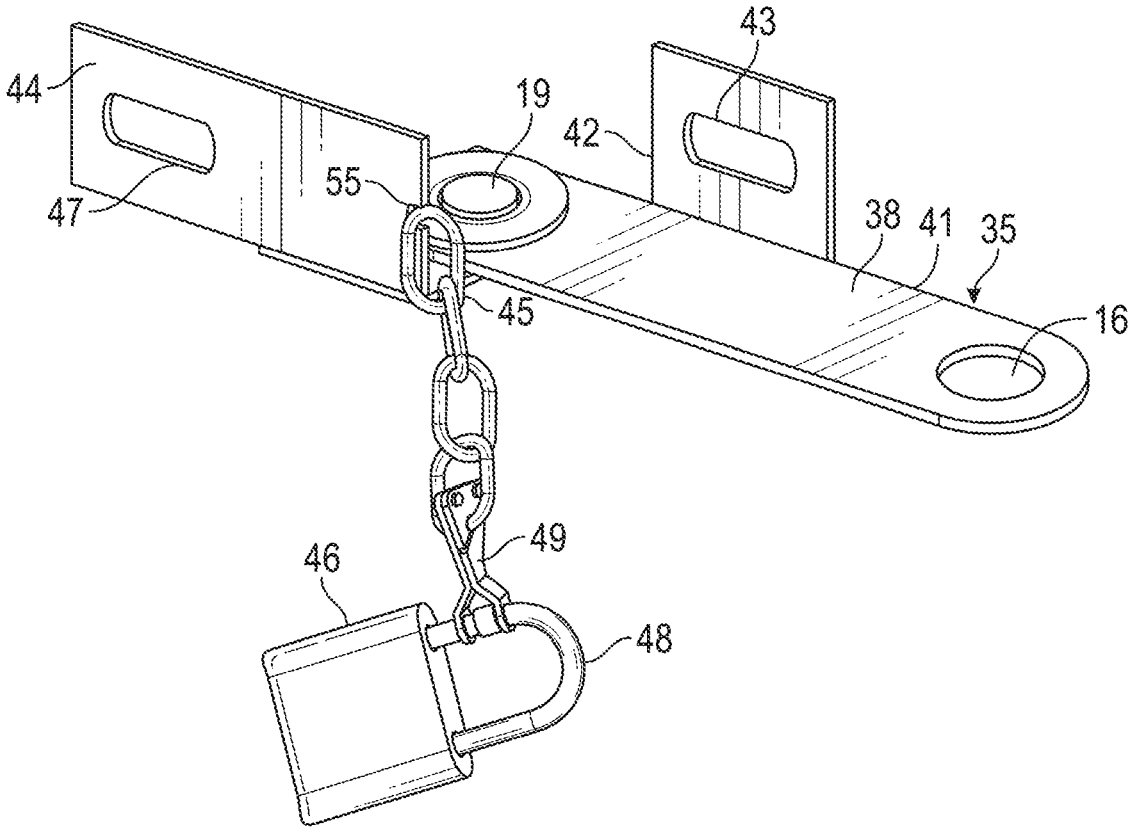
FIG. 4 is a top perspective view of the locking pivot device of FIG. 3 with an attachment chain secured to a typical padlock and secured to a stop plate of the locking pivot device.
Figure 5:
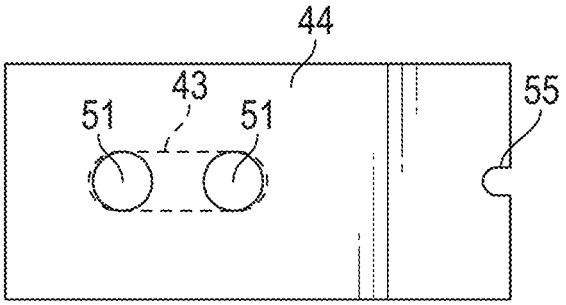
FIG. 5 is a rear elevation view of a modified stop plate.
Figure 6:
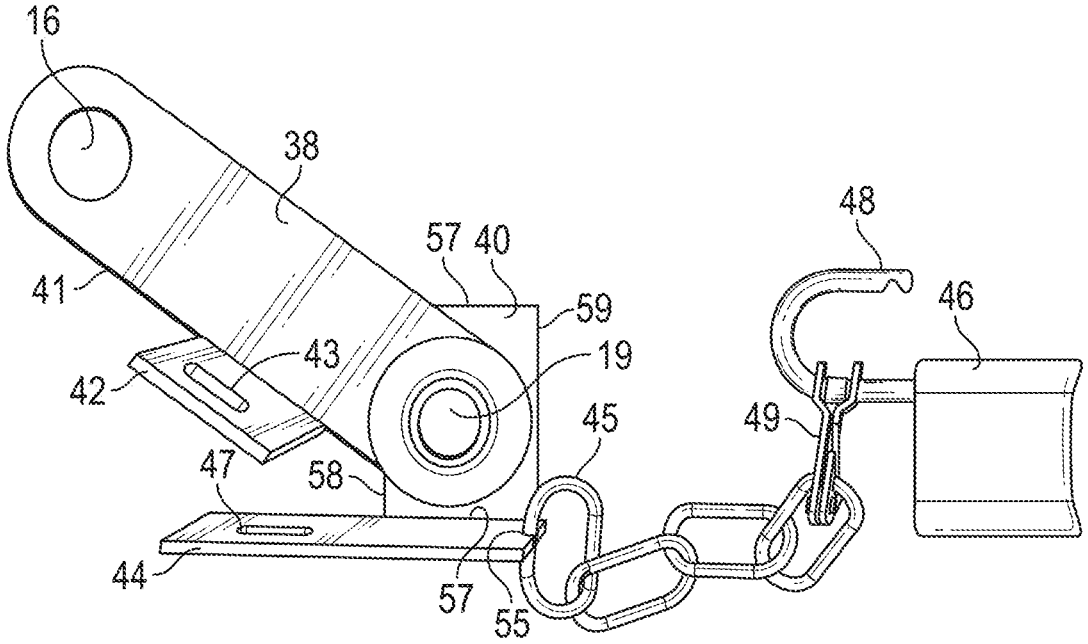
FIG. 6 is a top view of the locking pivot device of FIGS. 3 and 4 with a locking flange on the pivot arm rotated at an angle relative to the pivot mount or base of the device.

The first, locking pivot device 35 comprises an elongated plate or pivot arm 38, a pivot mount or mounting plate 40 pivotally connected to one end of pivot arm 38, a locking plate or flange 42 located on one side edge 41 of arm 38 and extending outward from a top surface of the arm 38, and a stop plate or lock hasp 44 extending outward from a top surface of pivot mount 40. Plate or pivot arm 38 is pivotally mounted at one end on a pivot pin 19 extending from pivot mount 40, in a similar manner to prior art device 12 described above. In some embodiments, locking flange 42 is oriented substantially perpendicular to pivot arm 38 and parallel to the longitudinal axis of arm 38, and stop plate or padlock hasp 44 is oriented perpendicular to mounting plate 40, as best seen in FIGS. 4, 6 and 8, but these parts may be angled differently in alternative embodiments as long as the locking flange 42 is pivoted into a position adjacent the stop plate or lock hasp 44 in the lid locking position of the pivot devices 35 and 36 (see FIG. 10). Locking flange 42 has an elongated slot 43 while stop plate 44 has an elongated slot 47. In alternative embodiments, one of the slots may be replaced by one or more circular holes 51, as seen in FIG. 5. The stop plate or lock hasp 44 is integrated with or secured to the pivot mounting plate rather than being a completely separate part as in the prior art arrangement described above, and is pre-aligned with the locking flange 42 on pivoted plate 38 rather than having to be aligned separately on installation by the installer. When the pivot mounting plate 40 is correctly mounted on the rim of the trash container as described in more detail below, lock hasp or stop plate 44 is automatically in the correct position and orientation for face-to-face engagement with locking flange 42 with the slots 43, 47 overlapping or aligned when the pivot plates and secured pipe or bar are rotated into the lid locking position. This makes installation of the pivot arms much easier. The stop plate 44 may be used for plastic dumpsters.

Locking flange 42 and stop plate 44 may be formed integrally with the respective pivot arm or plate 38 and mounting plate 40 and may be bent or formed to extend perpendicular to the respective pivot plate 38 and mounting plate 40, or may be formed as separate parts and secured to plates 38, 40 by welding or the like. In some embodiments, pivot mount or plate 40 has spaced side edges 57 and first and second end edges 58, 59, respectively, and the stop plate 44 is located at one of the side edges 57. Stop plate 44 is longer than pivot mount or plate 40 and extends outwards from side edge 57 beyond the first end edge 58 of plate or mount 40. In some embodiments, stop plate 44 has a length between opposite end edges which is around twice the distance between the first and second end edges 58, 59 of the mounting plate or pivot mount 40. Slot 47 is located in the part of stop plate 44 which protrudes from first end edge 58 of the pivot mount or plate 40.

As seen in FIGS. 4 and 8, one end edge 60 of stop plate 44 has a central notch or indent 55 which is provided as a weld point for attachment of a chain 45 of various lengths, diameters, and/or thicknesses to the locking pivot device 35. A short length of the chain 45 is shown secured or welded in notch 55 of plate 44 in FIGS. 4, 6 and 7. The opposite end of chain 45 is attached to a shackle 48 of a selected padlock 46 via a suitable connector 49, as seen in FIGS. 4 and 6. A padlock secured to the lockable pivot arm is much less likely to get lost and can be preset to a selected combination provided only to authorized users of the trash container. Trash collection truck drivers have an override key for opening the trash container when trash is collected. Another advantage of securing the padlock to the pivot mounting plate is that it is easier to lock the plate or pivot arm 38 to stop plate 40 when the padlock is readily available or when in low visibility or dark conditions.

In order to install the lid locking apparatus on a trash container, the pivot mounts or mounting plates 40, 20 of the respective pivot devices 35, 36 are first secured by welding or other fastening means (e.g., bolts to bolt to plastic trash container) at identical positions on the upper rim 62 on opposite sides of trash container 34 in an orientation in which the upper and lower edges (or longer edges) 58, 59 are parallel to the side edge of the dumpster lid in the closed position. As shown in FIG. 9B, the mounting plate 20 and padlock hasp 44 may be positioned in a variety of different installation angles (e.g., 45 degrees relative to horizontal, 90 degrees relative to horizontal, etc.) the installers choose, and not necessarily in a vertical orientation. For ease of installation, the height of plate 40 between the upper and lower edges may be substantially the same as the height of rim 62. The pivot mounting plate 40 of the locking pivot arm is positioned with the stop plate or padlock hasp 44 furthest away from the front end of the dumpster. In the installed position, the projecting end of hasp 44 extends in a direction upwards from the mounting plate 40 towards the top opening of the container, as seen in FIGS. 9 and 10. A length of metal pipe or bar 50 is first measured against the front end of the dumpster or trash container so that it is of sufficient length to be secured between the ends of pivot arms 35 and 36, and the pipe or bar 50 is then secured between openings 16 at the outer ends of the pivot arms, as seen in FIGS. 9 and 10. In FIG. 9, the pipe or bar 50 extends across the front of the container so that the lid 32 may be freely opened to deposit trash inside the container, and the locking flange 42 is spaced away from stop plate or hasp 44 with pivot arm 38 extending downwards and angled away from the stop plate.

Figure 7:
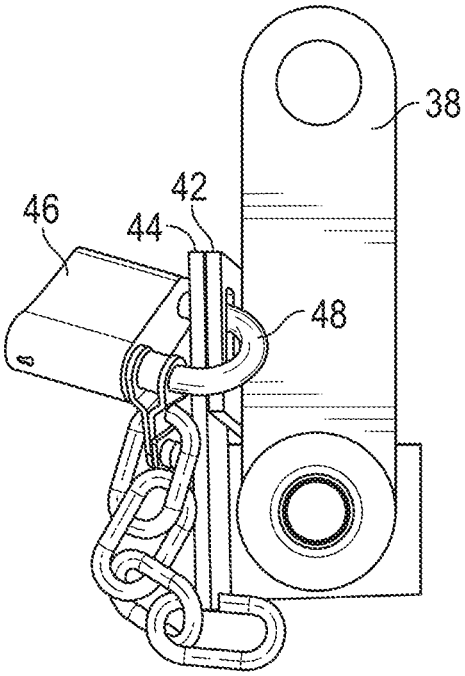
FIG. 7 is a top plan view of part of the locking pivot device of FIGS. 1, 3, 4, and 6 with the pivot arm rotated in an anti-clockwise direction from the position shown in FIG. 6 and a locking flange on the pivot arm engaged in face-to-face engagement with a stop plate on the pivot mount and locked to the stop plate with the padlock of FIG. 4.

In order to lock the lid 32 of the trash container in the closed position, the bar 50 is rotated upwards and rearwards over the top of the container, simultaneously pivoting the pivot arms of pivot devices 35 and 36 about their pivot axis so that the locking flange 42 of locking pivot arm 38 is rotated towards stop plate 44. FIG. 6 illustrates an intermediate position in which the locking flange is approaching stop plate 44. FIGS. 7, 8 and 10 illustrate the locking flange in the locking position in face-to-face engagement with the stop plate or hasp 44. As illustrated in FIG. 8, the slots 43, 47 are substantially aligned in this position. The stop plate 44 also identifies the locking position by preventing further rotation of arm 38 when locking flange 42 contacts plate 44. At the same time, the bar 50 extends across the closed lid 32 of the container, as seen in FIG. 10. The shackle 48 of the attached padlock 46 is then extended through the aligned slots or openings 43, 47 in the locking flange and stop plate, and locked to hold the bar 50 in the position shown in FIG. 10. This prevents access to the container by unauthorized individuals. When an authorized individual having a key or combination for padlock 46 wishes to deposit trash in the container, they simply unlock and remove the padlock from the aligned openings and move the lock bar 50 forwards to the front of the container, simultaneously rotating plate 38 back from the position shown in FIG. 10 to the position shown in FIG. 9.

The lid lock apparatus in the above embodiments is much easier to install and operate than the prior art apparatus of FIGS. 1 and 2. Unlike that apparatus in which the lock plate or lock hasp 15 was separate from the pivot device 12, the lock hasp or stop plate 44 in this apparatus is integral with or secured to the pivot mount or base plate 40 at the correct position and orientation to engage locking flange 42 with the slots overlapping or aligned when the pivot arm is rotated into the lid locking position. The stop plate also prevents further rearward movement of the pivot arms when the lid locking position is reached, unlike the prior art device (see FIG. 2). Additionally, a notch or indent is provided on the lock hasp for locating and welding the end of a chain secured to a padlock, so that the means for locking the apparatus in a lid locking position is readily available at all times for engagement through the aligned parts of the slots after opening and re-closing of the trash container lid.

Figure 11A:
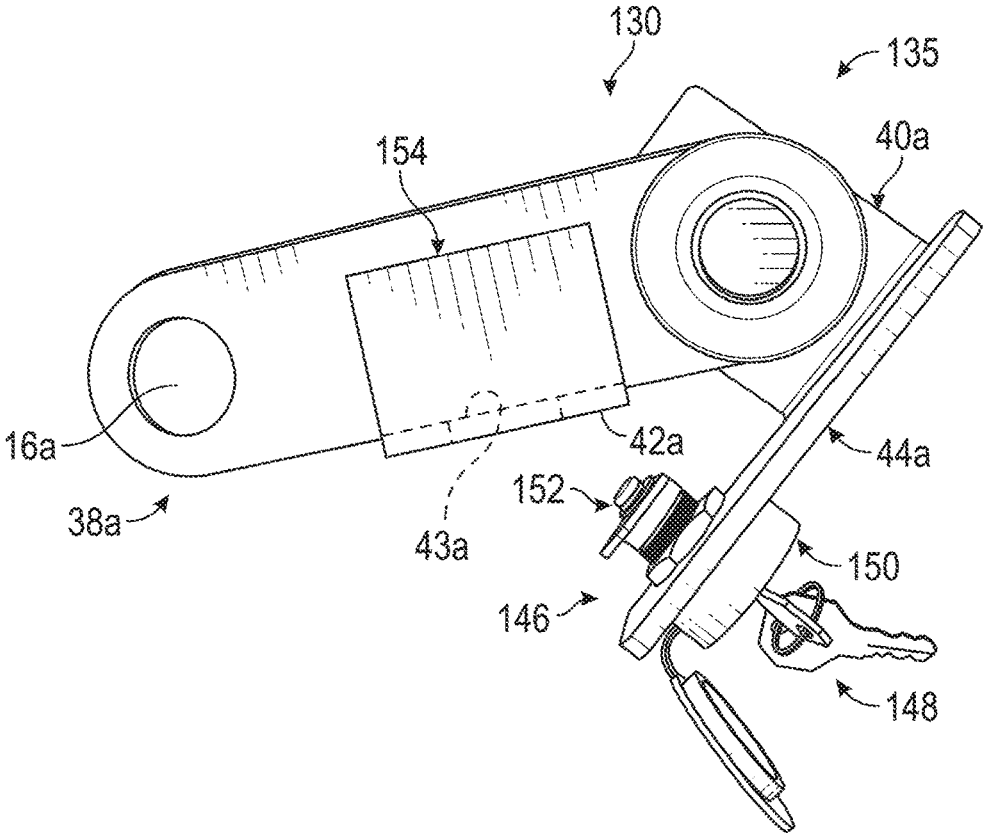
FIG. 11A is a top plan view of another embodiment of a lid locking apparatus for a trash container.
Figure 11B:
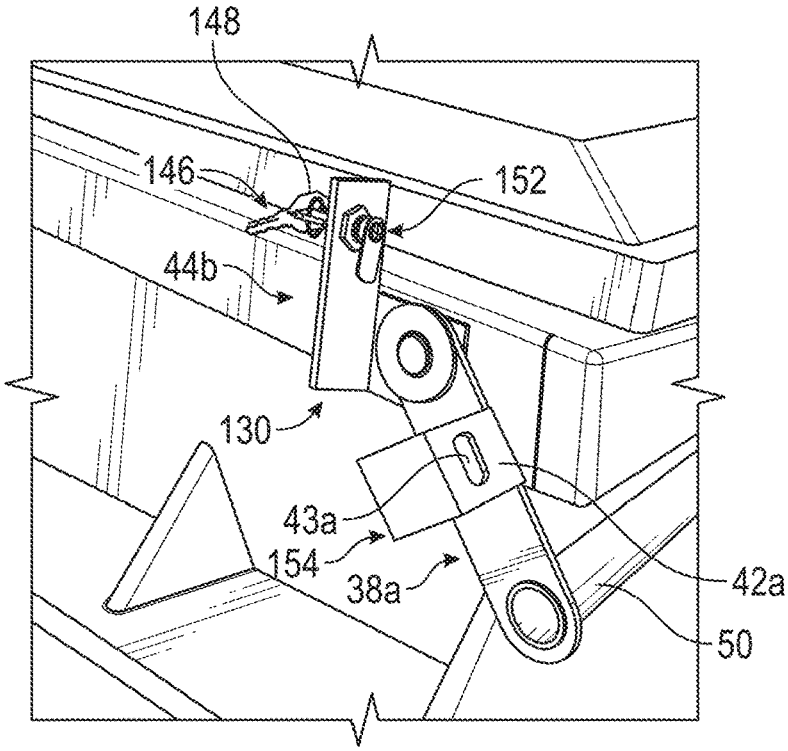
FIG. 11B is a perspective, broken away view of the top portion of a trash container with the arms of the lid locking apparatus of FIG. 11A pivotally secured on opposite sides of the container and a bar secured between the free ends of the arms, in the unlocked position.
Figure 11C:
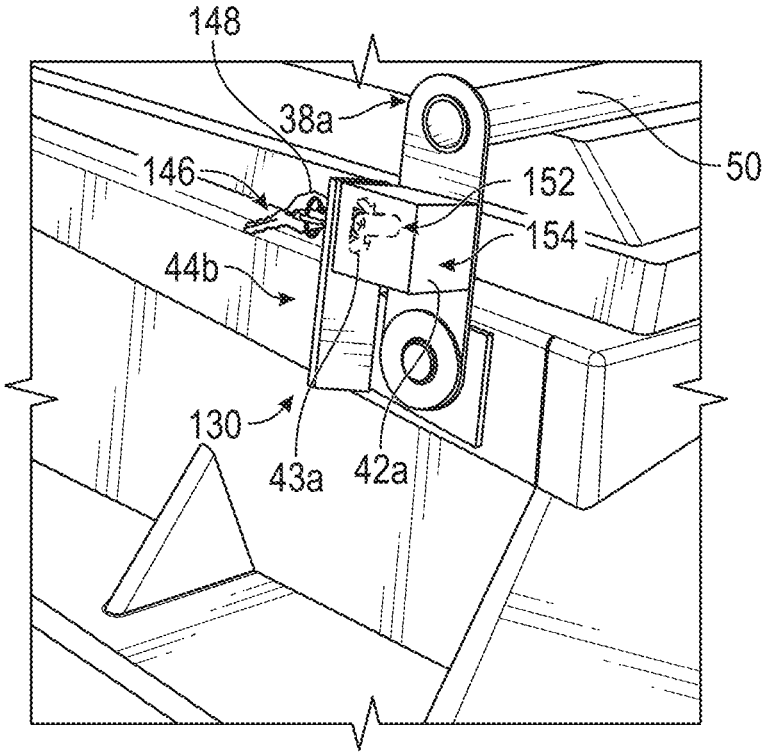
FIG. 11C is a perspective, broken away view, similar to FIG. 11A, but shows the lid locking apparatus of FIG. 11A in locked position.

FIGS. 11A-11C illustrate another embodiment of a lid lock apparatus 130 for locking a hinged lid 32 of a trash container 34 in a closed position. Elements in the lid lock apparatus 130 that are similar to those shown and described above will include a like reference number, but with an "a" suffix and will not be further described. The prior description on such elements is incorporated herein. The apparatus 130 basically comprises first, locking pivot device 135 and a second pivot device (e.g., second pivot device 36 shown in FIG. 3), which is not lockable. In one embodiment, the first, locking pivot device 135 is basically similar to the first, locking pivot device 135 shown and described with respect to FIGS. 3-10, except for the following differences. A stop plate 44*a* is similar to the stop plate 44 described with respect to FIGS. 3-10, except instead of the stop plate 44*a* including the elongated slot 47 and the use of chain 45/padlock 46/shackle 48/connector 49/notch 55, the stop plate 44*a* includes a key-operated cam lock mechanism 146. Rotation of a key 148 received in a key receiving member 150 of the cam lock mechanism 146 controls rotation of a cam 152. In an unlock configuration such as that seen in FIGS. 11A and 11B, the cam 152 is oriented for receipt through elongated slot 43*a* of locking flange 42*a*. As shown in FIG. 11C, when the pivot arm 38*a* is pivoted so that it abuts the stop plate 44 and the cam 152 is received through elongated slot 43*a* of locking flange 42*a*, the cam lock mechanism 146 may be locked by rotating the key 148 in the key receiving member 150, which causes rotation of the cam 152 to an orientation that overlaps a solid portion of the locking flange 42*a*, preventing the pivot arm 38*a* from pivoting relative to the stop plate 44*a*, locking the pivot arm 38*a* and bar 50 in position and preventing the lid 32 of the trash container 34 from being opened. Along a rear of the locking flange 42*a* is a small box cover 154 that covers the cam 152 when the apparatus 130 is locked, preventing people from removing (e.g., prying off with screwdriver) the cam 152 from the key-operated cam lock mechanism 146.

Figure 11D:
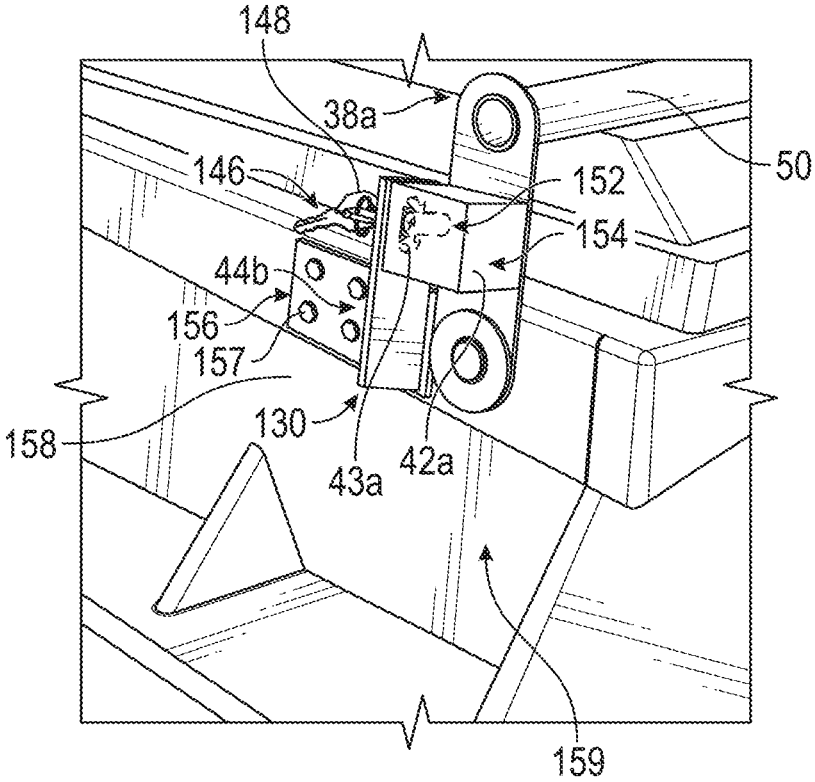
FIG. 11D is a perspective, broken away view, similar to FIG. 11D, and shows a lid locking apparatus similar to the lid locking apparatus of FIGS. 11A-11C, but with a mounting plate for bolting the lid locking apparatus to the side of a plastic trash container.

FIG. 11D shows an alternative embodiment of the lid lock apparatus 130 for use with a plastic trash container 155. The lid lock apparatus 130 is connected (e.g., welded) to a metal mounting plate or bracket 156, which includes a plurality of bolt holes receiving a plurality of bolts 157 for mounting the mounting plate 156 and the lid lock apparatus 130 to a side 158 of a plastic trash container 159.

Figure 11E:
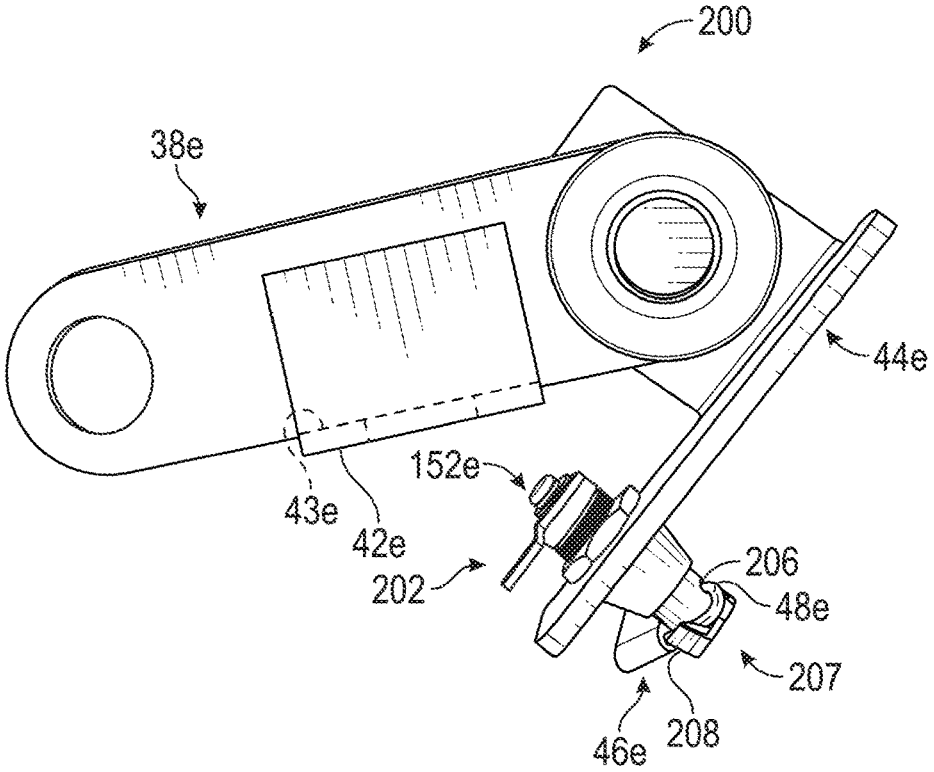
FIG. 11E is a top plan view of a further embodiment of a lid locking apparatus for a trash container.
Figure 11F:
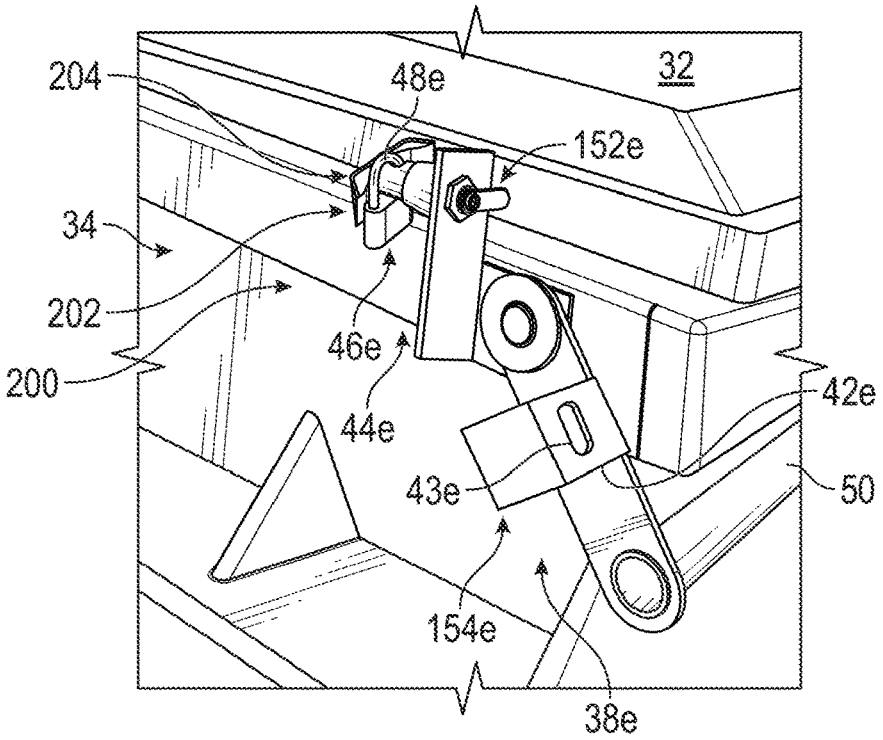
FIG. 11F is a perspective, broken away view of the top portion of a trash container with the arms of the lid locking apparatus of FIG. 11E pivotally secured on opposite sides of the container and a bar secured between the free ends of the arms, in the unlocked position.
Figure 11G:
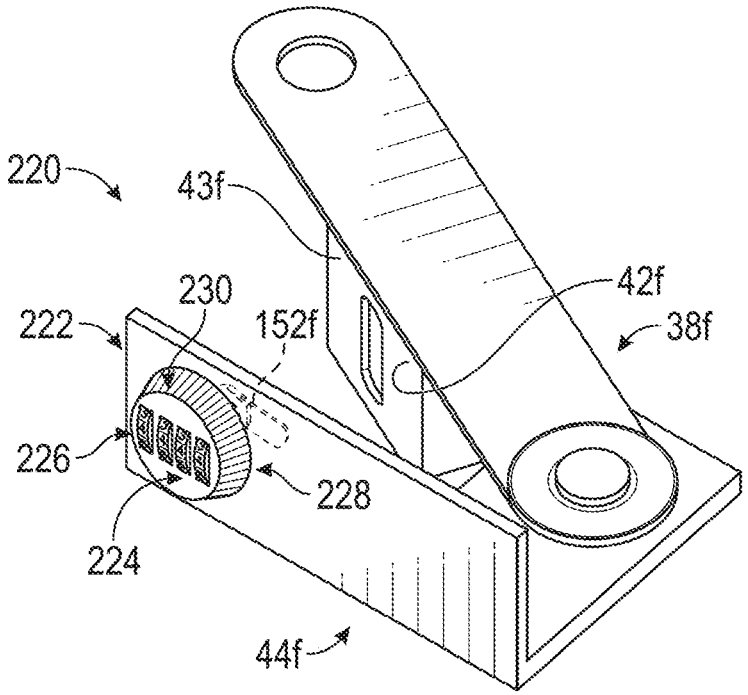
FIG. 11G is a top plan view of a further embodiment of a lid locking apparatus for a trash container.
Figure 11H:
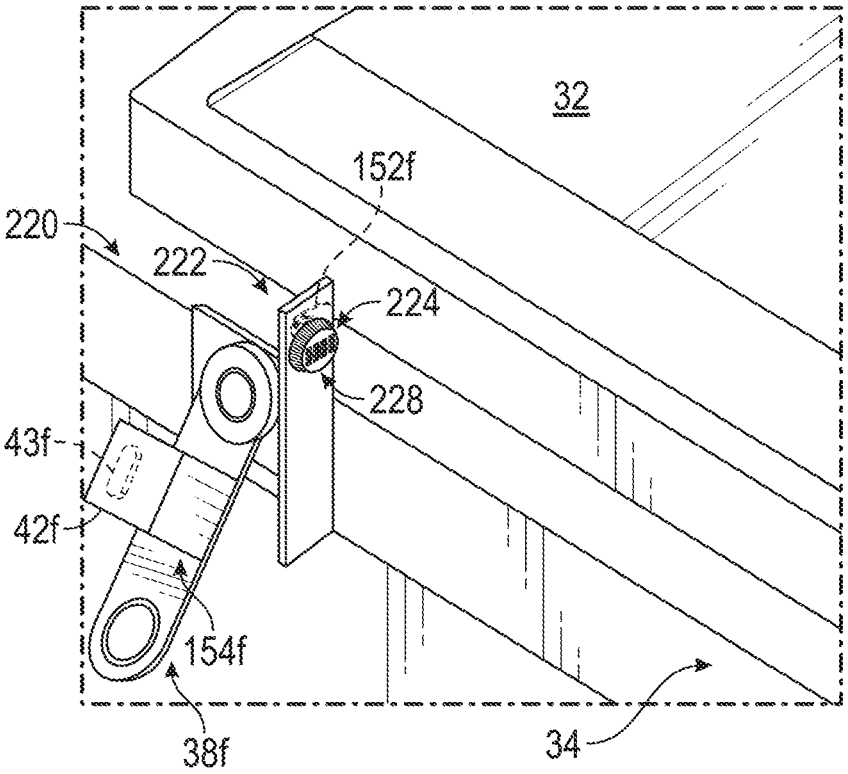
FIG. 11H is a perspective, broken away view of the top portion of a trash container with the arms of the lid locking apparatus of FIG. 11E pivotally secured on opposite sides of the container and a bar secured between the free ends of the arms, in the unlocked position.
Figure 11I:
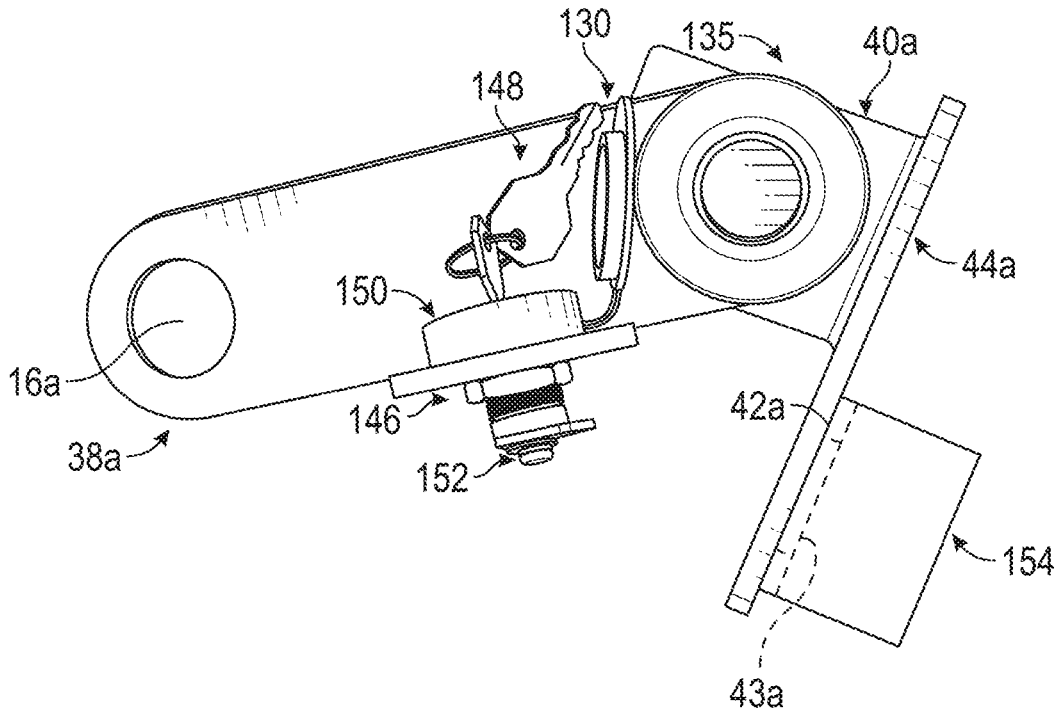
FIG. 11I is a top plan view of a further embodiment of a lid locking apparatus for a trash container that is similar to the embodiment of FIG. 11A, except that key-operated cam lock mechanism is shown in a reversed orientation so that a user can unlock the cam lock from a front of the trash container.
Figure 11J:
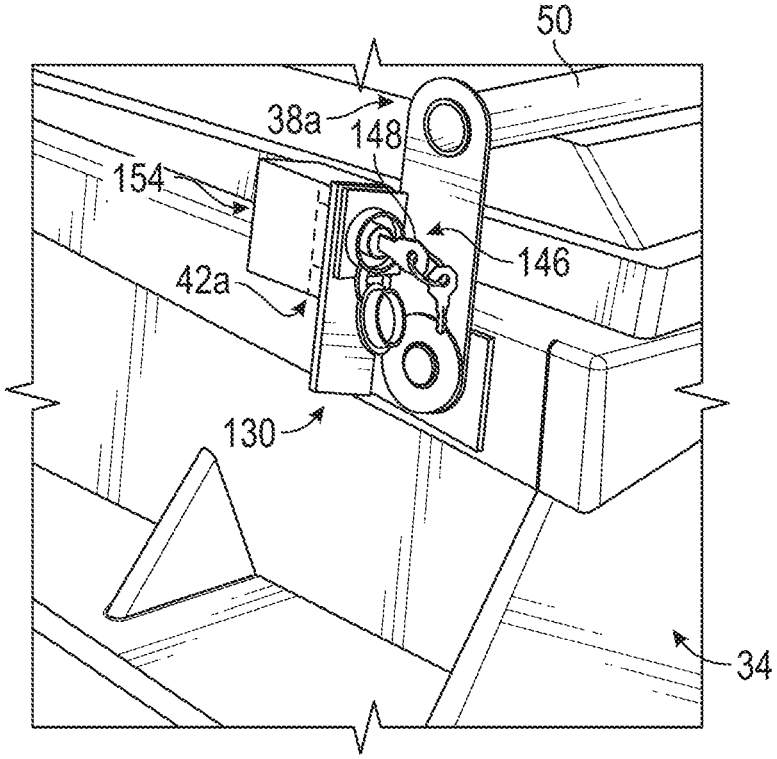
FIG. 11J is a perspective, broken away view of the top portion of a trash container, similar to FIG. 11B, with the key-operated cam lock mechanism of FIG. 11I shown in a reversed orientation compared to the key-operated cam lock mechanism of FIG. 11B so that a user can unlock the cam lock from a front of the trash container.

FIGS. 11I and 11J illustrate a further embodiment of a lid locking apparatus 130 for a trash container that is similar to the lid locking apparatus 130 shown in FIGS. 11A-11C, except that key-operated cam lock mechanism 146 is in a reversed orientation relative to that shown in FIGS. 11A-11C, so that a user can unlock the cam lock from a front of the trash container 34. The key-operated cam lock mechanism 146 may be oriented forward (FIGS. 11I, 11J) or rearward (FIGS. 11A-11C), depending on the installer's needs.

Figure 12:
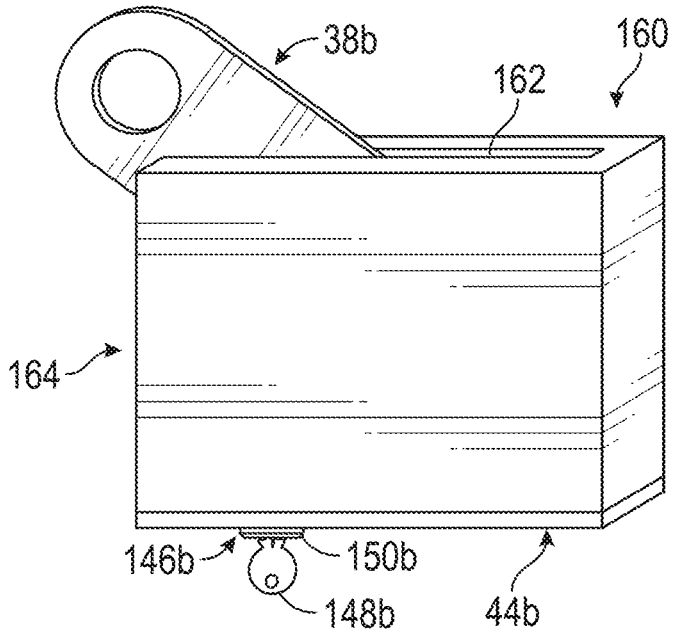
FIG. 12 is a top view of a further embodiment of a lid locking apparatus for a trash container.
Figure 13:
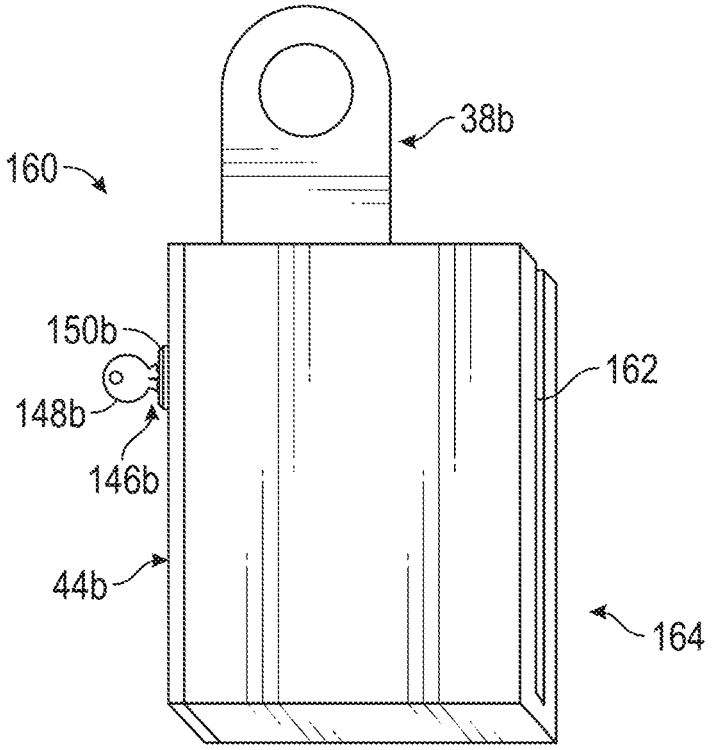
FIG. 13 is another top view of the lid locking apparatus of FIG. 12.
Figure 14:
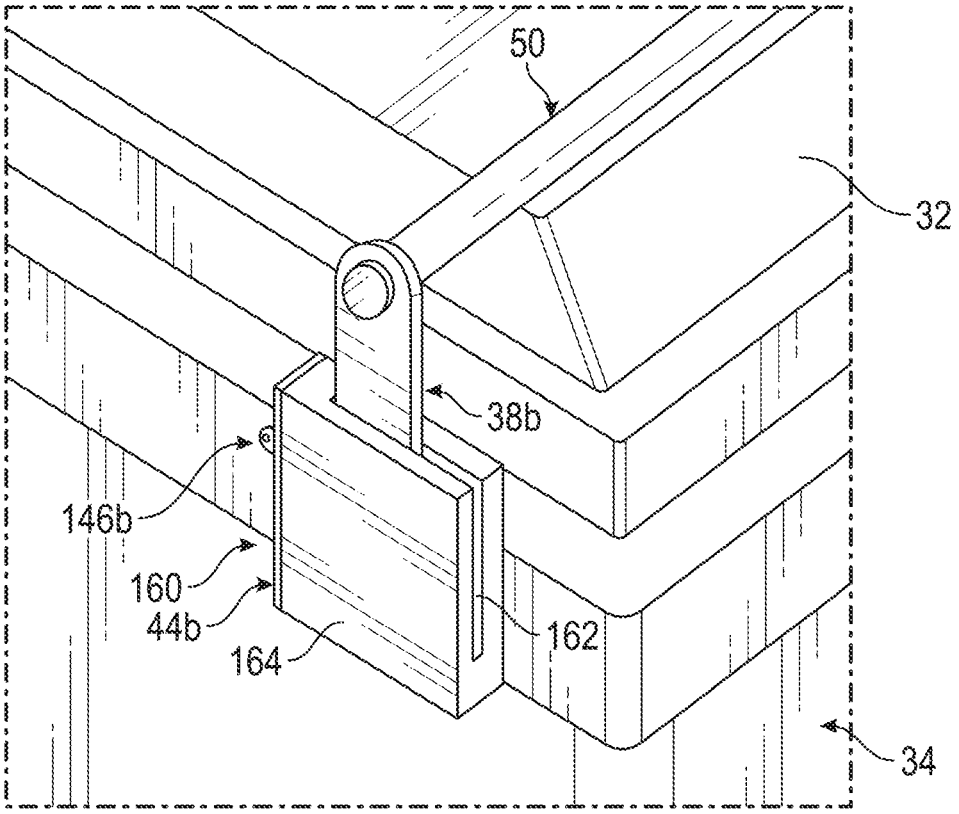
FIG. 14 is a perspective, broken away view of the top portion of a trash container with the arms of the lid locking apparatus pivotally secured on opposite sides of the container and a bar secured between the free ends of the arms, with the lid locking apparatus of FIGS. 11-13 shown in the locked position.

FIGS. 12-14 illustrate a further embodiment of a lid lock apparatus 160 for locking a hinged lid 32 of a trash container 34 in a closed position. Elements in the lid lock apparatus 130 that are similar to those shown and described above will include a like reference number, but with a "b" suffix and will not be further described. The prior description on such elements is incorporated herein. The apparatus 160 is similar to the apparatus 130, except the pivot arm 38*b* is pivotally disposed within a slot 162 of a rectangular block mount 164. The block mount 164 includes a key-operated lock mechanism 146*b*. In alternative embodiments, the apparatus 160 may include one or more of a key-operated lock mechanism, a padlock lock mechanism, a combination lock mechanism, electronic locking mechanism (e.g., actuated by RFID/sensor, wireless mobile electronic computing device via Bluetooth® (a registered mark of Bluetooth Sig, Inc. of Kirkland, Wash.) or other wireless connection, FOB). Rotation of a key 148*b* received in key receiving member 150*b* of the lock mechanism 146*b* controls rotation of a cam or other locking member. In an unlock configuration, the locking member allows the pivot arm 38*b* to freely pivot within slot 162 of the block mount 164. When the pivot arm 38*b* is pivoted so that it abuts or is adjacent to the a stop plate/wall 44*b* of the block mount 164, the lock mechanism 146*b* may be locked by rotating the key 148*b* in the key receiving member 150*b*, which causes rotation of the cam or movement of a locking member to an orientation that prevents the pivot arm 38*b* from pivoting relative to the stop plate/wall 44*b*, locking the pivot arm 38*b* and bar 50 in position and preventing the lid 32 of the trash container 34 from being opened. The configuration of the block mount 164 covers the locking member when the apparatus 160 is locked, preventing people from removing the locking member from the key-operated lock mechanism 146.

Figure 15:
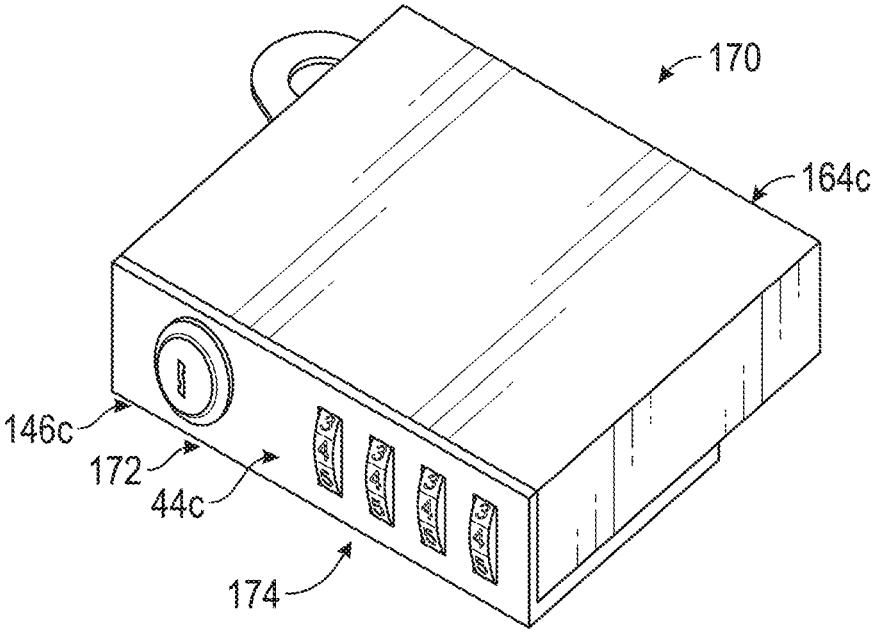
FIG. 15 is a perspective view of an additional embodiment of a lid locking apparatus for a trash container.
Figure 16:
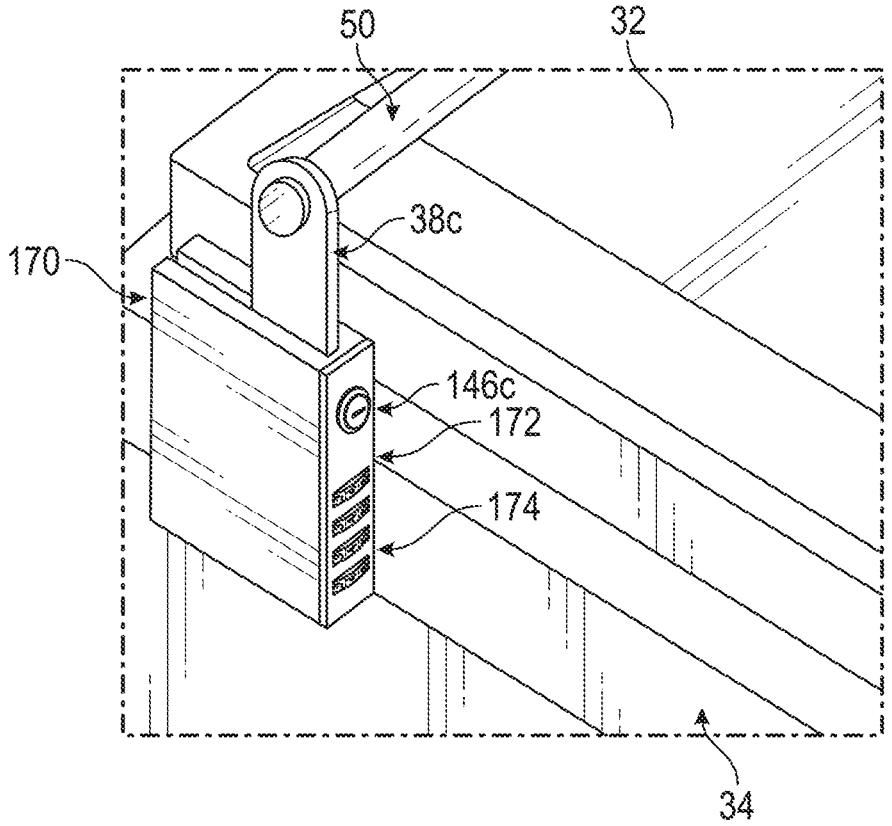
FIG. 16 is a perspective, broken away view of the top portion of a trash container with the arms of the lid locking apparatus pivotally secured on opposite sides of the container and a bar secured between the free ends of the arms, with the lid locking apparatus of FIG. 15 shown in the locked position.

FIGS. 15 and 16 illustrate an additional embodiment of a lid lock apparatus 170 for locking a hinged lid 32 of a trash container 34 in a closed position. Elements in the lid lock apparatus 160 that are similar to those shown and described above will include a like reference number, but with a "c" suffix and will not be further described. The prior description on such elements is incorporated herein. The apparatus 180 is similar to the apparatus 160, except a locking mechanism 172 includes a both a combination lock mechanism 174 and a key-operated lock mechanism 146*c*. The combination lock mechanism 174 may be normally used to trigger a locking member to lock/unlock the locking mechanism 172, but in the event that the combination is not known or to facilitate operation of the locking mechanism (e.g., by a refuse company emptying the trash container 34, the key-operated lock mechanism 146*c* is used to lock/unlock the locking mechanism 172

Figure 17:
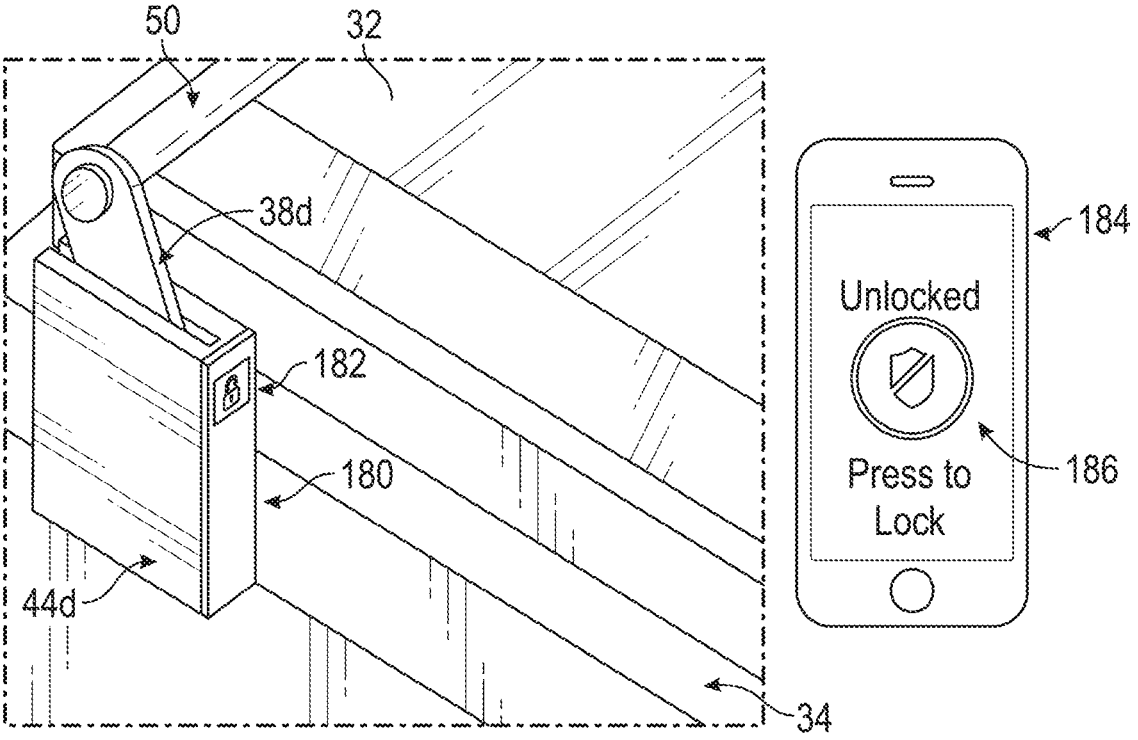
FIGS. 17 and 18 are perspective, broken away views of the top portion of a trash container with the arms of the lid locking apparatus pivotally secured on opposite sides of the container and a bar secured between the free ends of the arms, with a still further embodiment of a lid locking apparatus shown and a screen shot of an application for wireless handheld device.
Figure 18:
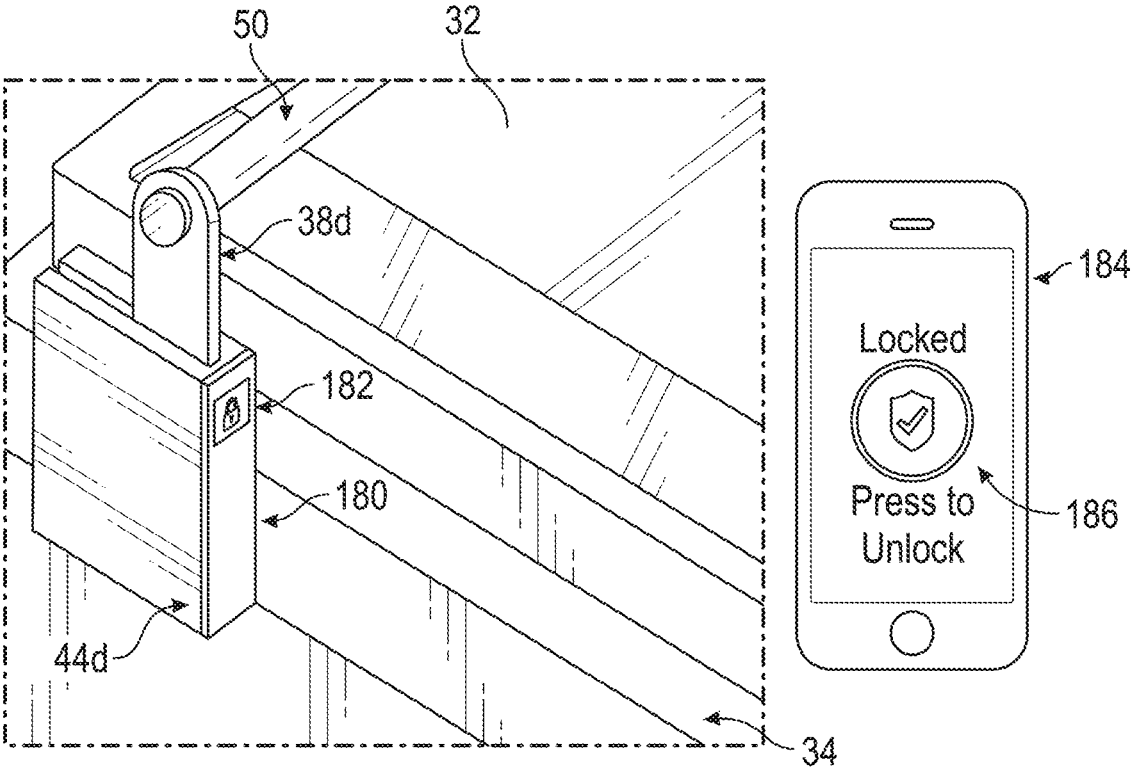

FIGS. 17 and 18 illustrate a still further embodiment of a lid locking apparatus 180 for locking a hinged lid 32 of a trash container 34 in a closed position. Elements in the lid lock apparatus 180 that are similar to those shown and described above will include a like reference number, but with a "d" suffix and will not be further described. The prior description on such elements is incorporated herein. The apparatus 180 is similar to the apparatus 160 and the apparatus 170, except that the lid locking apparatus 180 includes an electronic locking mechanism 182 that electronically actuates and disengages a locking member. In the embodiment shown, the electronic locking mechanism 182 is controlled by a software application ("app") on a wireless mobile electronic computing device 184 including one or more modules to control the locking and unlocking of the locking member of the electronic locking mechanism 182. The app may include at least a "lock" mode and an "unlock" mode. In FIG. 17, the electronic locking mechanism 182 is shown in an unlocked configuration and the app on the device 184 shows this "unlocked" state. To lock the electronic locking mechanism 182, the pivot arm 38*b* and bar 50 may be moved to the position shown in FIG. 18 and the icon 186 on the device 184 shown in FIG. 17 is pressed to cause the electronic locking mechanism 182 to actuate (e.g., via solenoid or other electronic actuation mechanism) the locking member to locked position, preventing the lid 32 of the trash container 34 from being opened. To unlock the electronic locking mechanism 182, the icon 186 on the device 184 shown in FIG. 18 is pressed to cause the locking member of the electronic locking mechanism 182 to disengage and be unlocked, allowing the pivot arm 38*b* and the bar 50 to be pivoted out of the way, and the lid 32 of the trash container 34 to be opened. The electronic locking mechanism 182 may communicate with the device 184 via Bluetooth® (a registered mark of Bluetooth Sig, Inc. of Kirkland, Wash.) wireless connection or other wireless connection. The electronic locking mechanism 182 may include one or more power sources (e.g., one or more solar powered rechargeable power sources, one or more batteries, one or more rechargeable batteries) In alternative embodiments, one or more other devices such as, but not limited to, key frequency operated button ("FOB")/FOB pad, RFID/sensor, infrared device/chip/sensor, may be used or associated with the electronic locking mechanism 182 to lock/unlock the electronic locking mechanism 182.

FIGS. 11E and 11F illustrate a still further embodiment of a lid locking apparatus 200 for locking a hinged lid 32 of a trash container 34 in a closed position. Elements in the lid lock apparatus 200 that are similar to those shown and described above will include a like reference number, but with an "e" suffix and will not be further described. The prior description on such elements is incorporated herein. The apparatus 200 is similar to the apparatus 130, except that instead of the lid locking apparatus 200 including a key-operated cam lock mechanism 146, the apparatus 200 includes a cam lock mechanism 202 that is secured by a shackle 48*e* of a padlock 46*e*. The apparatus 200 includes a spring-loaded turn knob 204 that controls rotation of cam 152*e* when the turn knob 204 is pressed in. The turn knob 204 includes opposite wings 208 to facilitate turning of the turn knob 204. The turn knob 204 includes a hole 206 therein to receive the shackle 48*e* of the padlock 46*e*. The turn knob 204 must be pressed in for cam 152*e* to turn. When the padlock 46*e* is engaged, the turn knob 204 cannot be pressed in, and, thus, cannot turn. Although not shown, in one embodiment, a short length of chain is secured or welded to the plate 44*e* at one end and at an opposite end of chain the chain is attached to the shackle 48*e* of the selected padlock 46*e* via a suitable connector. Rotation of a turn knob 204 controls rotation of the cam 152*e*. In an unlock configuration, the cam 152*e* is oriented for receipt through elongated slot 43*e* of locking flange 42*e*. When the pivot arm 38*e* is pivoted so that it abuts the stop plate 44*e* and the cam 152*e* is received through elongated slot 43*e* of locking flange 42*e*, the cam lock mechanism 202 may be locked by pressing in and rotating the turn knob 204, which causes rotation of the cam 152*e* to an orientation that overlaps a solid portion of the locking flange 42*e*, preventing the pivot arm 38*e* from pivoting relative to the stop plate 44*e*, locking the pivot arm 38*e* and bar 50 in position and preventing the lid 32 of the trash container 34 from being opened. Similar to that described above, the rear of the locking flange 42*e* may include a small box cover 154*e* that covers the cam 152*e* when the apparatus 200 is locked, preventing people from removing (e.g., prying off with screwdriver) the cam 152*e* from the cam lock mechanism 202.

FIGS. 11G and 11H illustrate a still further embodiment of a lid locking apparatus 220 for locking a hinged lid 32 of a trash container 34 in a closed position. Elements in the lid lock apparatus 220 that are similar to those shown and described above will include a like reference number, but with a "f" suffix and will not be further described. The prior description on such elements is incorporated herein. The apparatus 220 is similar to the apparatus 130, except that instead of the lid locking apparatus 220 including a key-operated cam lock mechanism 146, the apparatus 220 includes a cam lock mechanism 222 that is secured by a combination lock 224 having a three digit combination 226. When the open/correct combination is entered, rotation of turn knob 228 controls rotation of cam 152*f*. The turn knob 228 includes a serrated periphery 230 to facilitate turning of the turn knob 228. When the incorrect combination is entered, the turn knob 228, and, hence, the cam 152*f*, cannot be turned. Rotation of a turn knob 228 controls rotation of the cam 152*f*. In an unlock configuration, the cam 152*f* is oriented for receipt through elongated slot 43*f* of locking flange 42*f*. When the pivot arm 38*f* is pivoted so that it abuts the stop plate 44*f* and the cam 152*f* is received through elongated slot 43*f* of locking flange 42*f*, the cam lock mechanism 222 may be locked by rotating the turn knob 228, which causes rotation of the cam 152*f* to an orientation that overlaps a solid portion of the locking flange 42*f*, preventing the pivot arm 38*f* from pivoting relative to the stop plate 44*f*, locking the pivot arm 38*f* and bar 50 in position and preventing the lid 32 of the trash container 34 from being opened. In this locked configuration, the combination is changed to an incorrect combination. Similar to that described above, the rear of the locking flange 42*f* may include a small box cover 154*f* that covers the cam 152*f* when the apparatus 220 is locked, preventing people from removing (e.g., prying off with screwdriver) the cam 152*f* from the cam lock mechanism 222.

In one or more alternative embodiments, a lid locking apparatus may include one or more of the different types of lock mechanisms shown and/or described herein including, but not limited to a key-operated lock mechanism, a padlock lock mechanism, a combination lock mechanism, and electronic locking mechanism (e.g., actuated by RFID/sensor, wireless mobile electronic computing device via Bluetooth® (a registered mark of Bluetooth Sig, Inc. of Kirkland, Wash.) or other wireless connection, FOB).

FIGS. 20-23 illustrate a still further embodiment of a lid locking apparatus 300 for locking a hinged lid 32 of a trash container 34 in a closed position. Elements in the lid lock apparatus 300 that are similar to those shown and described above will include a like reference number, but with a "g" suffix and will not be further described. The prior description on such elements is incorporated herein. The apparatus 300 includes a plate 305, a bracket 310, a pivot arm 315, a box 320, and a rotating lock mechanism (e.g., key-operated cam lock mechanism) 146*g* operably associated with the box 320. The plate 305, the bracket 310, the pivot arm 315, the box 320, and/or the rotating lock mechanism 146*g* together form a pivot device.

The plate 305 has a generally rectangular shape with top/bottom flanges 325, 330 and holes 335 in corners 340.

The bracket 310 has a generally rectangular shape with a raised base section 345 with a hole in the form of an elongated slot 350, and mounting flanges 355, 360. The mounting flanges 355, 360 include holes 365 in corners 370. The raised base section 345 includes coupling section 375 with a hole 380.

The pivot arm 315 has an elongated flat configuration with an upper hole 385 at a second end that receives the bar 50 and a lower hole 390 at a first end. The pivot arm 315 includes a hole in the form of an elongated slot 395.

The box 320 has a substantially rectangular box configuration with housing 400 having a hole 405 for receiving the key-operated cam lock mechanism 146*g* and a mounting flange 410 with holes 415 near opposite ends 420.

A round 425 along with a fastener 430 are used to pivotally attached the pivot arm 315 to the bracket 310 via the lower hole 390 of the pivot arm 315 and the hole 380 of the coupling section 375 of the bracket 310.

Respective fasteners 435 extend through the holes 415 of the mounting flange 410 of the box, the holes 365 of the bracket 310, and the holes 335 of the plate 305 to mount the lid locking apparatus 300 to a side 440 of the trash container 34.

The key-operated cam lock mechanism 146*g* is operably received within the hole 405 of the box 320 for controlling rotation of cam 152*g*.

Figure 22:
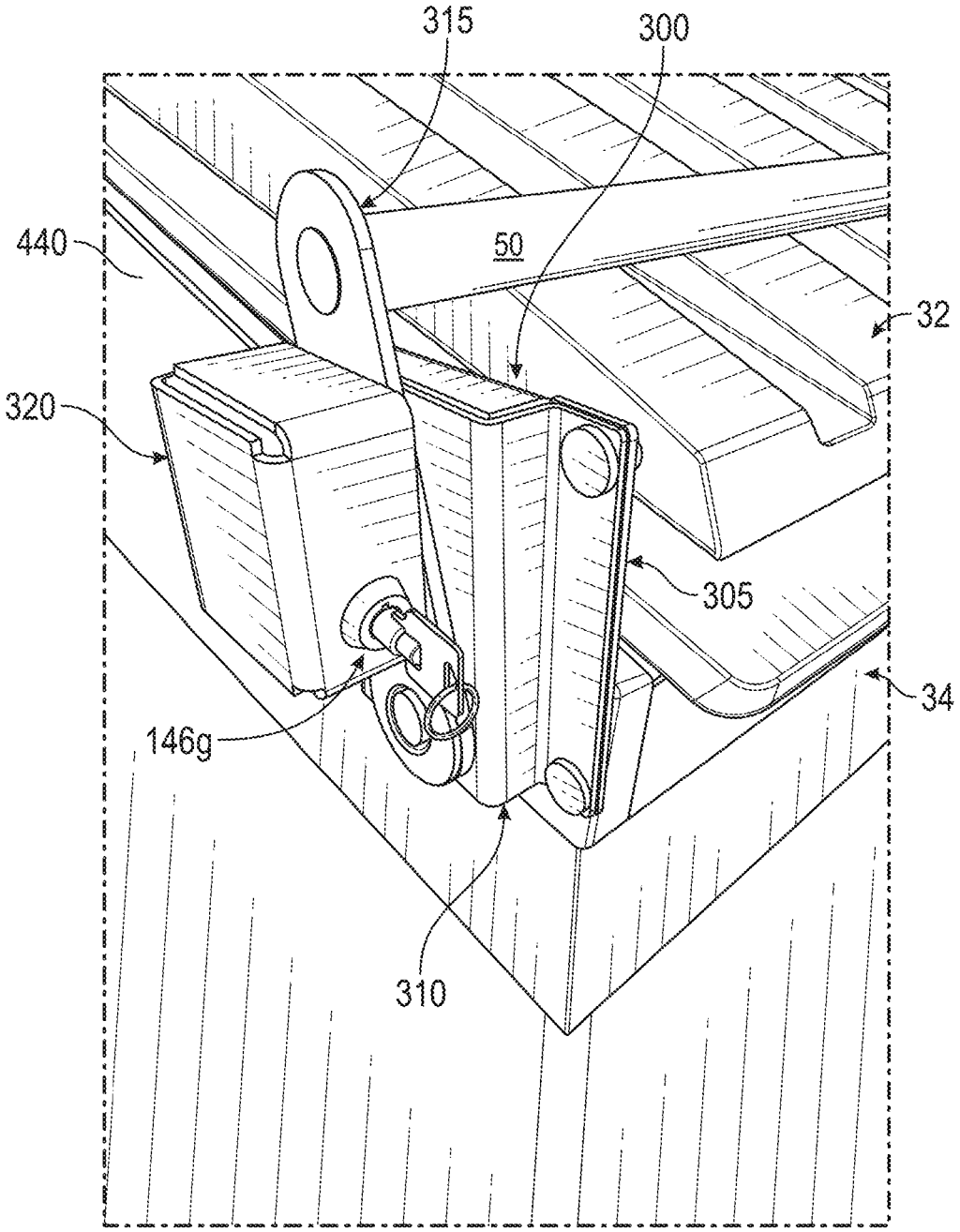
FIGS. 22 and 23 are perspective, broken away views of the top portion of a trash container with the arms of the lid locking apparatus pivotally secured on opposite sides of the container and a bar secured between the free ends of the arms, with the embodiment of the lid locking apparatus of FIGS. 20 and 21 shown in a locked condition in FIG. 22 and an unlocked condition in FIG. 23.

In the position shown in FIG. 22, the key-operated cam lock mechanism 146*g* and the lid locking apparatus 300 is in a locked condition. In this condition, the cam 152*g* forms a movable element that is disposed through both the slot 395 of the pivot arm 315 and the slot 350 of the bracket 310, locking the pivot arm 315, and hence, the bar 50 in position, preventing the lid 32 of the trash container 34 from being opened.

Figure 23:
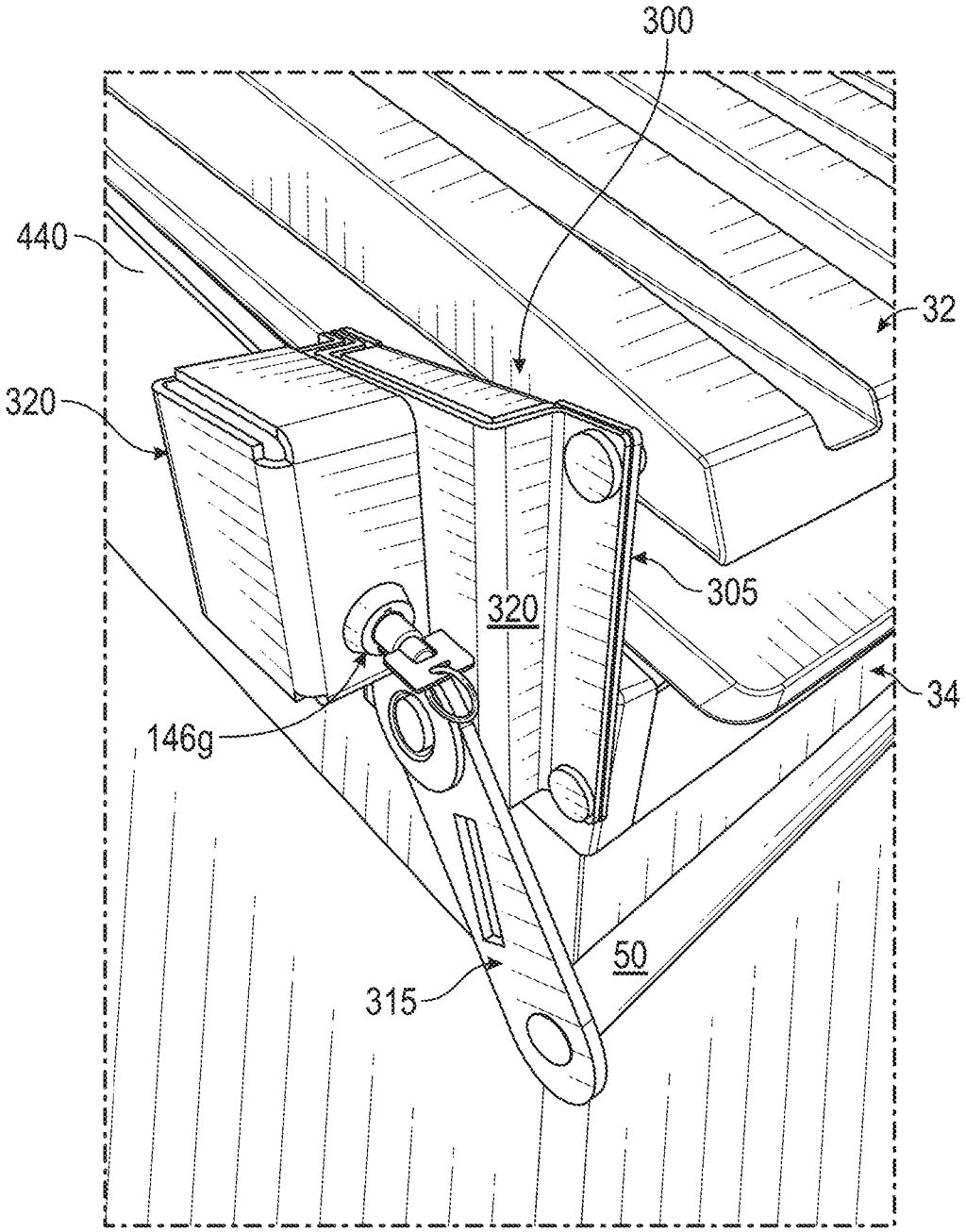
Figure 24:
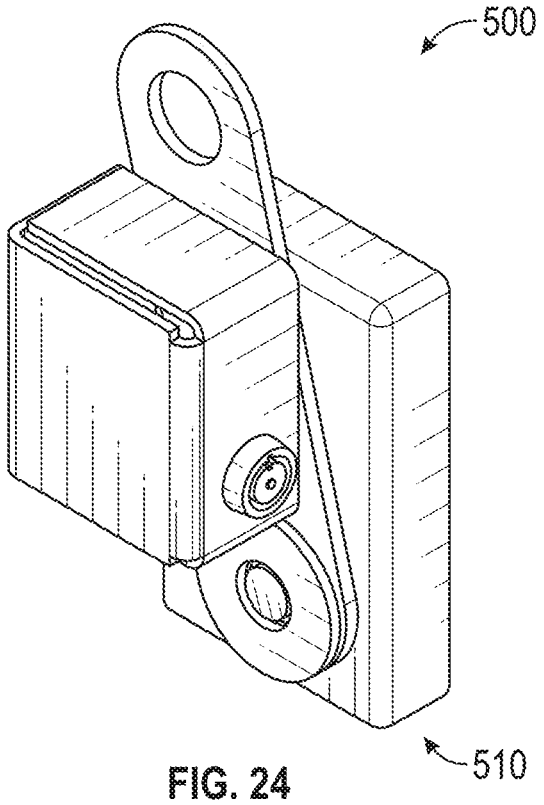
FIG. 24 is a perspective view of a still further embodiment of a lid locking apparatus for a trash container.
Figure 25:
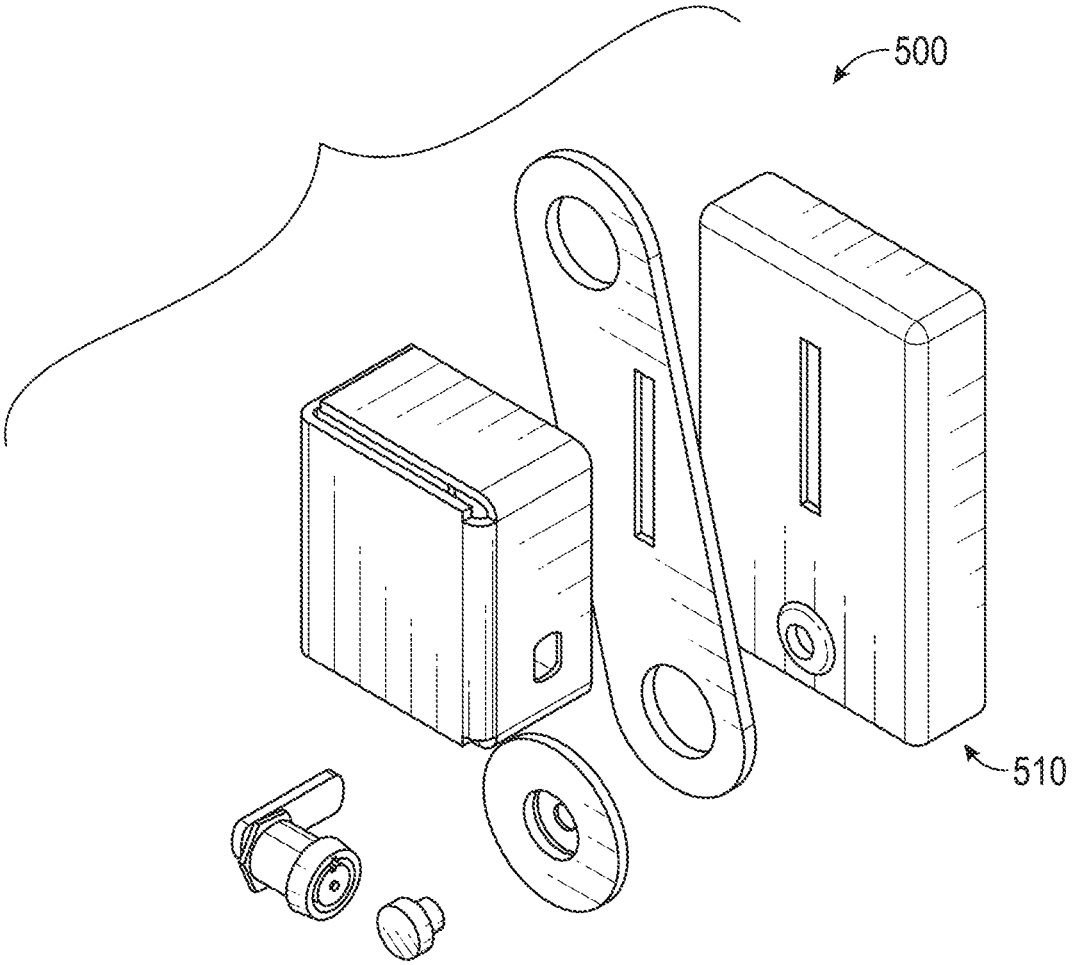
FIG. 25 is an exploded perspective view of the lid locking apparatus for a trash container of FIG. 24.
Figure 26:
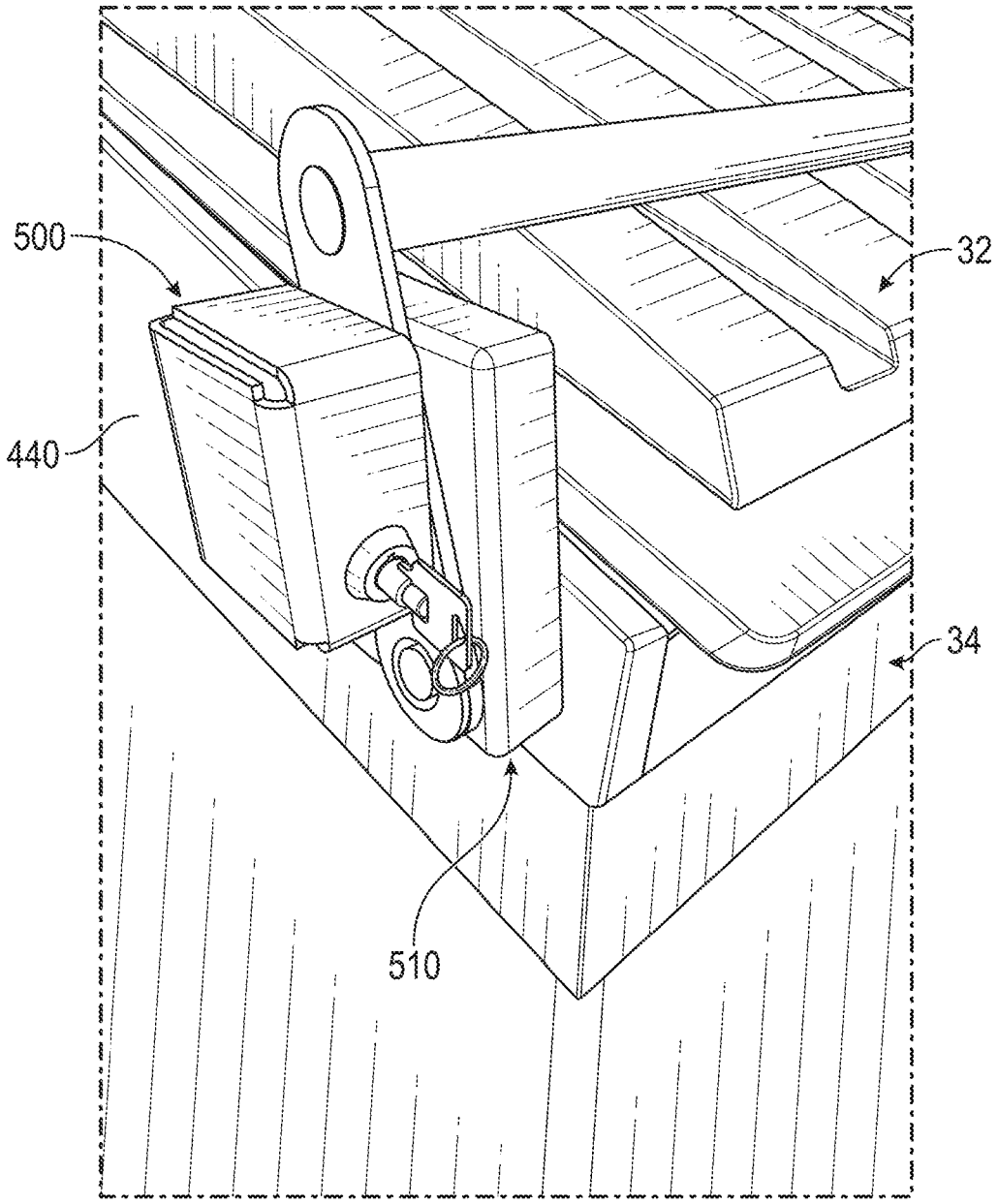
FIGS. 26 and 27 are perspective, broken away views of the top portion of a trash container with the arms of the lid locking apparatus pivotally secured on opposite sides of the container and a bar secured between the free ends of the arms, with the embodiment of the lid locking apparatus of FIGS. 24 and 25 shown in a locked condition in FIG. 26 and an unlocked condition in FIG. 27.
Figure 27:
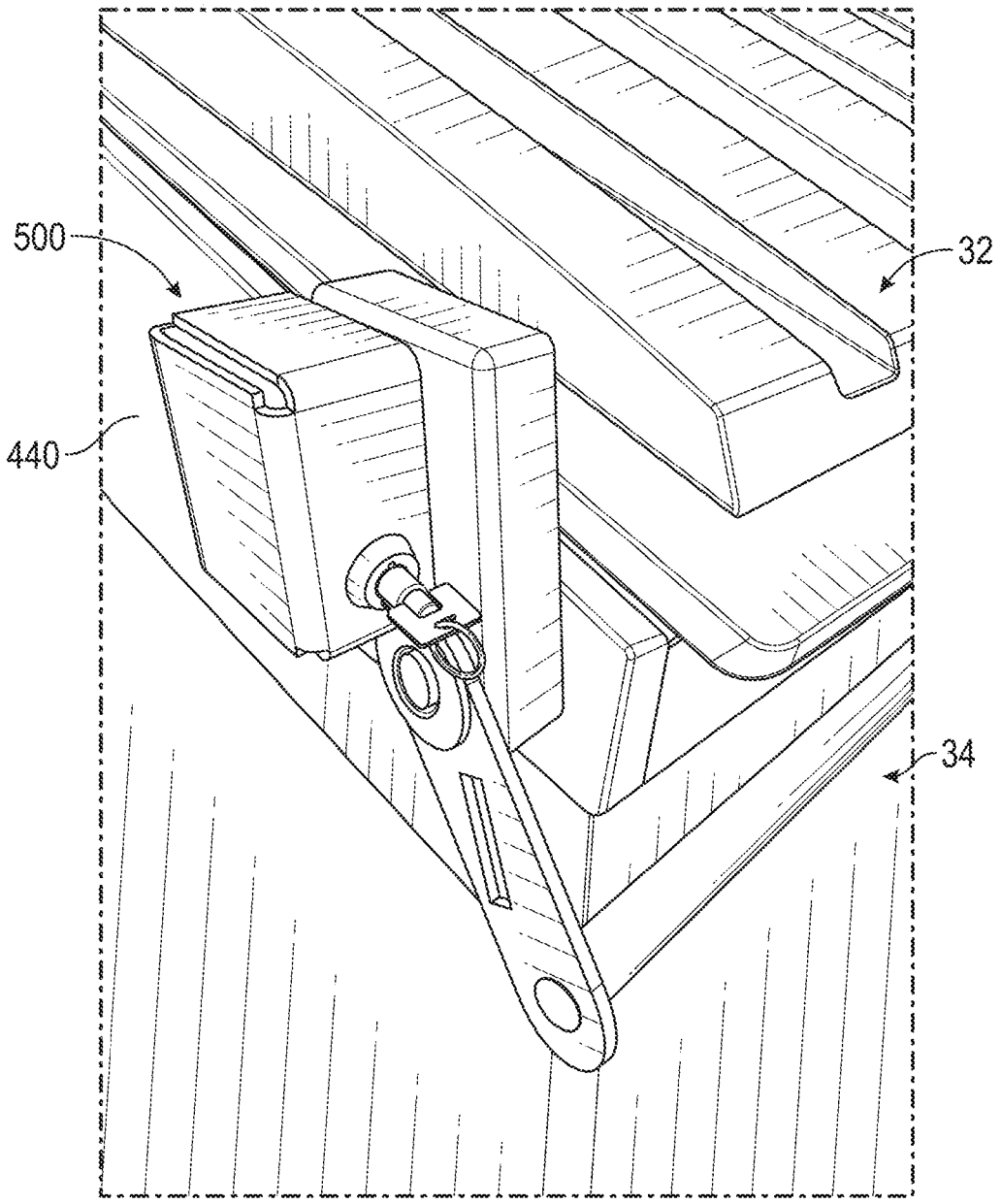

In the position shown in FIG. 23, the key-operated cam lock mechanism 146*g* and the lid locking apparatus 300 is in an unlocked condition. In this condition, the cam 152*g* is removed from and not engaged within the slot 395 of the pivot arm 315 and the slot 350 of the bracket 310, allowing the pivot arm 315, and hence, the bar 50 to be freely swung to an unlocked, out-of-the way, position, allowing the lid 32 of the trash container 34 to be freely opened and/or closed.

In one or more embodiments, the rotating lock mechanism 146*g* is a key-operated cam lock mechanism, a combination lock, and/or a combination-controlled cam lock mechanism.

With reference to FIGS. 24-27 another embodiment of a lid locking apparatus 500 for locking a hinged lid 32 of a trash container 34 in a closed position is shown. Elements in the lid lock apparatus 500 that are similar to those shown and described above are shown, but not further described. The prior description on such elements is incorporated herein. The apparatus 500 is similar to the apparatus 300, except that the apparatus 500 includes a bracket 510 that is similar to the bracket 310, except that the bracket 510 does not include mounting flanges 355, 360, holes 365 in corners 370 of the mounting flanges 355, 360, nor fasteners 435. Some of the advantages of the lid locking apparatus 500 over the lid locking apparatus 300 are less material, no rivets, and a slimmer, less bulky design.

Figure 28:
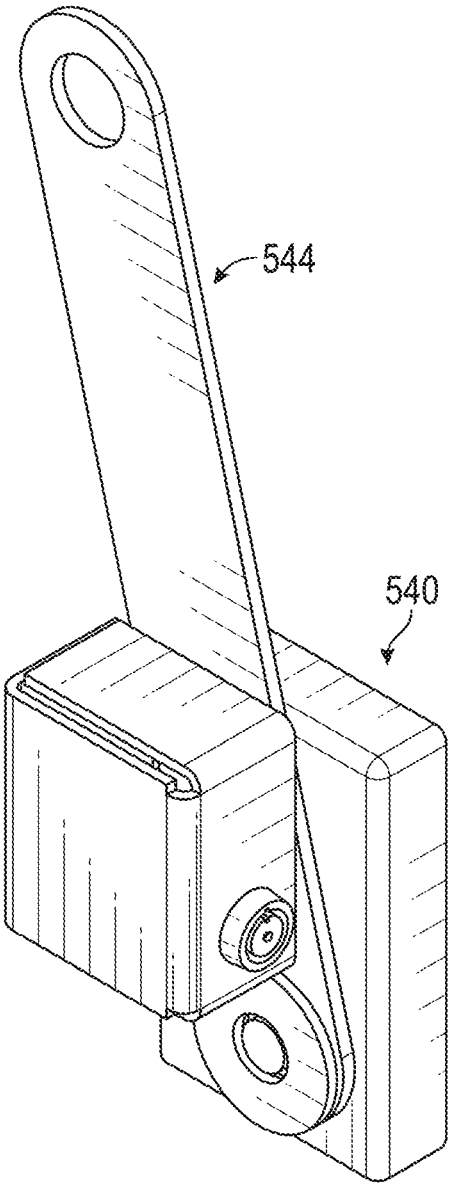
FIG. 28 is a perspective view of another embodiment of a lid locking apparatus for a trash container.

With reference to FIG. 28, an additional embodiment of a lid locking apparatus 540 for locking a hinged lid 32 of a trash container 34 in a closed position is shown. Elements in the lid lock apparatus 540 that are similar to those shown and described above are shown, but not further described. The prior description on such elements is incorporated herein. The apparatus 540 is similar to the apparatus 500, except that the apparatus 540 includes a pivot arm 544 with an arm length that is 1.5 times the arm length of the pivot arm 315*h* shown in FIGS. 24-27.

Another aspect of the involves the key-operated lock mechanism 146, 146*b*, 146*c*, 146*g* being provided with any lock keyway (e.g., any Master Lock® keyway). Cylinders of the key-operated lock mechanism 146, 146*b*, 146*c*, 146*g* are pinned to match the keyway the customer is already using and the cylinders installed in/provided for the key-operated lock mechanism 146, 146*b*, 146*c*, 146*g*. This allows the customers to keep their existing keys, which will work on the key-operated lock mechanism 146, 146*b*, 146*c*, 146*g*, without having to replace them.

In one or more alternative embodiments, a lid locking apparatus may include one or more of the different types of lock mechanisms shown and/or described herein including, but not limited to a key-operated lock mechanism, a padlock lock mechanism, a combination lock mechanism, and electronic locking mechanism (e.g., actuated by RFID/sensor, wireless mobile electronic computing device via Bluetooth® (a registered mark of Bluetooth Sig, Inc. of Kirkland, Wash.) or other wireless connection, FOB).

Figure 19:
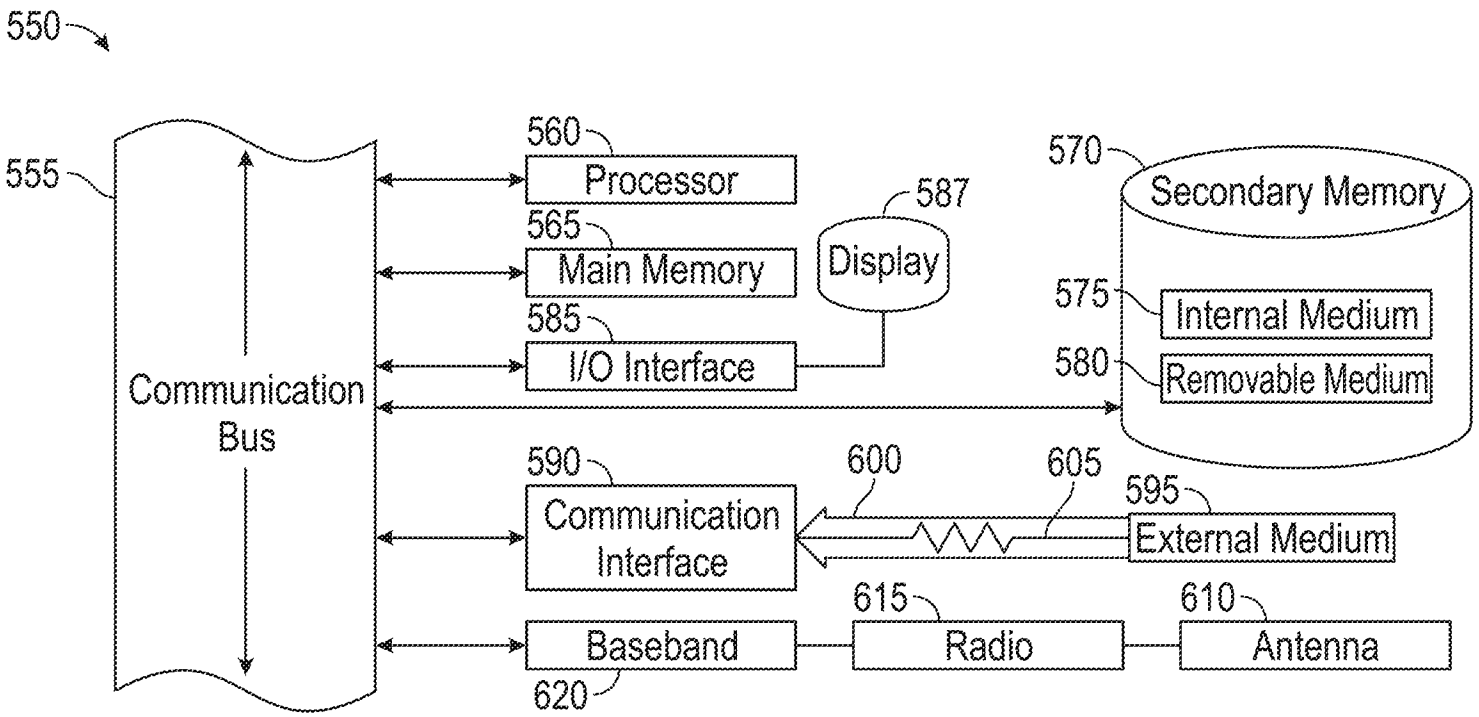
FIG. 19 is a block diagram illustrating an example wired or wireless processor enabled device that may be used in connection with various embodiments described herein.
Figure 20:
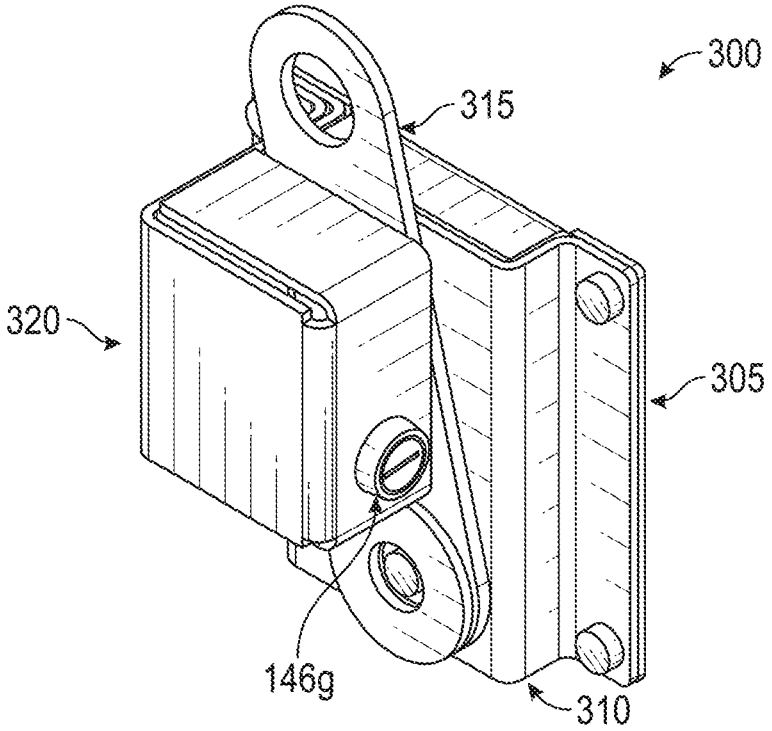
FIG. 20 is a perspective view of a further embodiment of a lid locking apparatus for a trash container.
Figure 21:
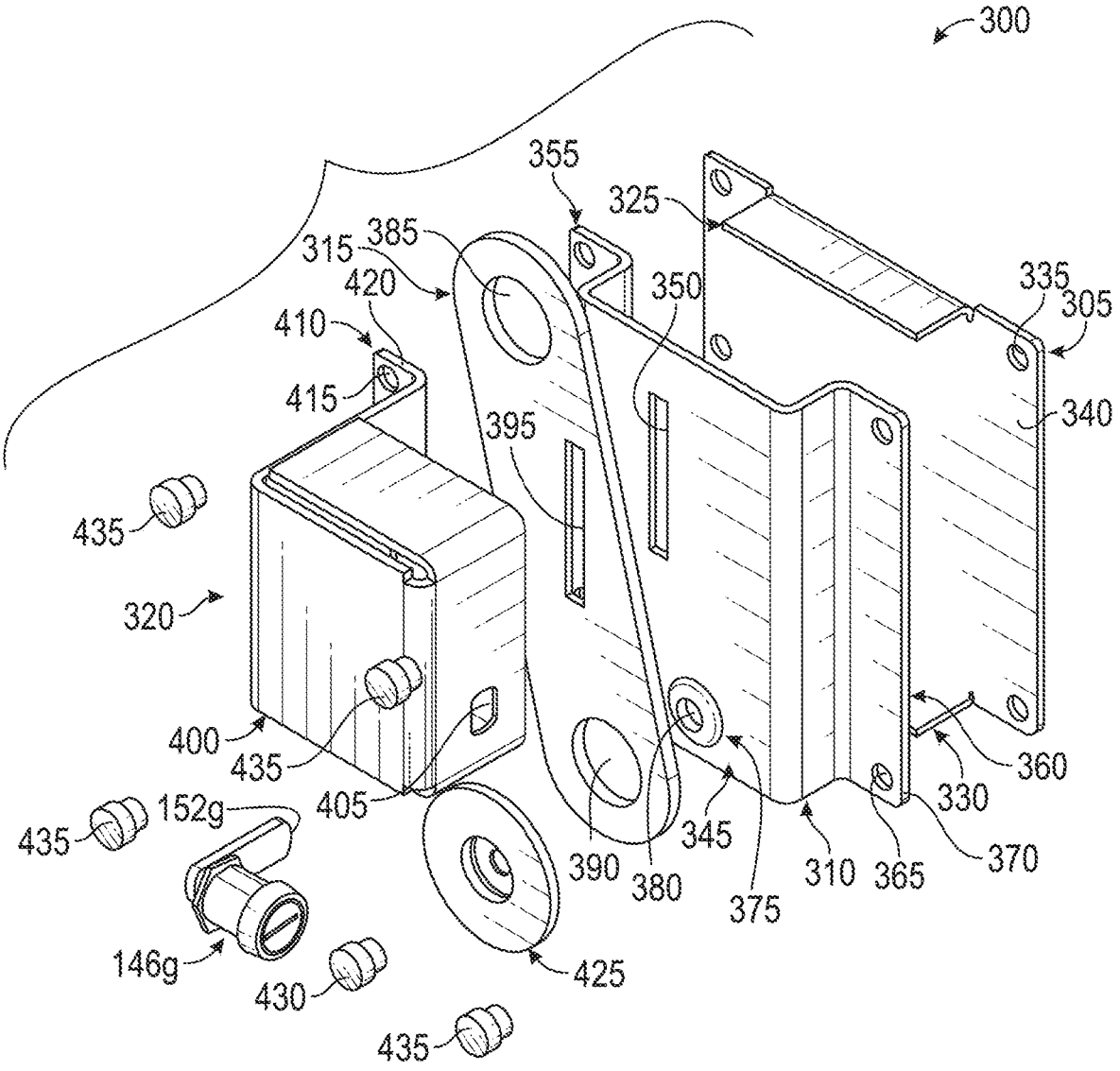
FIG. 21 is an exploded perspective view of the lid locking apparatus for a trash container of FIG. 20.

FIG. 19 is a block diagram illustrating an example wired or wireless system 550 that may be used in connection with various embodiments described herein. For example the system 550 may be used as or in conjunction with the electronic locking mechanism 182, wireless mobile electronic computing device 184, key frequency operated button ("FOB")/FOB pad, RFID/sensor, infrared device/chip/sensor as previously described with respect to FIGS. 17 and 18. The system 550 can be a conventional personal computer, computer server, personal digital assistant, smart phone, tablet computer, or any other processor enabled device that is capable of wired or wireless data communication. Other computer systems and/or architectures may be also used, as will be clear to those skilled in the art.

The system 550 preferably includes one or more processors, such as processor 560. Additional processors may be provided, such as an auxiliary processor to manage input/output, an auxiliary processor to perform floating point mathematical operations, a special-purpose microprocessor having an architecture suitable for fast execution of signal processing algorithms (e.g., digital signal processor), a slave processor subordinate to the main processing system (e.g., back-end processor), an additional microprocessor or controller for dual or multiple processor systems, or a coprocessor. Such auxiliary processors may be discrete processors or may be integrated with the processor 560.

The processor 560 is preferably connected to a communication bus 555. The communication bus 555 may include a data channel for facilitating information transfer between storage and other peripheral components of the system 550. The communication bus 555 further may provide a set of signals used for communication with the processor 560, including a data bus, address bus, and control bus (not shown). The communication bus 555 may comprise any standard or non-standard bus architecture such as, for example, bus architectures compliant with industry standard architecture ("ISA"), extended industry standard architecture ("EISA"), Micro Channel Architecture ("MCA"), peripheral component interconnect ("PCI") local bus, or standards promulgated by the Institute of Electrical and Electronics Engineers ("IEEE") including IEEE 488 general-purpose interface bus ("GPIB"), IEEE 696/S-100, and the like.

System 550 preferably includes a main memory 565 and may also include a secondary memory 570. The main memory 565 provides storage of instructions and data for programs executing on the processor 560. The main memory 565 is typically semiconductor-based memory such as dynamic random access memory ("DRAM") and/or static random access memory ("SRAM"). Other semiconductor-based memory types include, for example, synchronous dynamic random access memory ("SDRAM"), Rambus dynamic random access memory ("RDRAM"), ferroelectric random access memory ("FRAM"), and the like, including read only memory ("ROM").

The secondary memory 570 may optionally include an internal memory 575 and/or a removable medium 580, for example a floppy disk drive, a magnetic tape drive, a compact disc ("CD") drive, a digital versatile disc ("DVD") drive, etc. The removable medium 580 is read from and/or written to in a well-known manner. Removable storage medium 580 may be, for example, a floppy disk, magnetic tape, CD, DVD, SD card, etc.

The removable storage medium 580 is a non-transitory computer readable medium having stored thereon computer executable code (i.e., software) and/or data. The computer software or data stored on the removable storage medium 580 is read into the system 550 for execution by the processor 560.

In alternative embodiments, secondary memory 570 may include other similar means for allowing computer programs or other data or instructions to be loaded into the system 550. Such means may include, for example, an external storage medium 595 and an interface 570. Examples of external storage medium 595 may include an external hard disk drive or an external optical drive, or and external magneto-optical drive.

Other examples of secondary memory 570 may include semiconductor-based memory such as programmable read-only memory ("PROM"), erasable programmable read-only memory ("EPROM"), electrically erasable read-only memory ("EEPROM"), or flash memory (block oriented memory similar to EEPROM). Also included are any other removable storage media 580 and communication interface 590, which allow software and data to be transferred from an external medium 595 to the system 550.

System 550 may also include an input/output ("I/O") interface 585. The I/O interface 585 facilitates input from and output to external devices. For example the I/O interface 585 may receive input from a keyboard or mouse and may provide output to a display 587. The I/O interface 585 is capable of facilitating input from and output to various alternative types of human interface and machine interface devices alike.

System 550 may also include a communication interface 590. The communication interface 590 allows software and data to be transferred between system 550 and external devices (e.g. printers), networks, or information sources. For example, computer software or executable code may be transferred to system 550 from a network server via communication interface 590. Examples of communication interface 590 include a modem, a network interface card ("NIC"), a wireless data card, a communications port, a PCMCIA slot and card, an infrared interface, and an IEEE 1394 fire-wire, just to name a few.

Communication interface 590 preferably implements industry promulgated protocol standards, such as Ethernet IEEE 802 standards, Fiber Channel, digital subscriber line ("DSL"), asynchronous digital subscriber line ("ADSL"), frame relay, asynchronous transfer mode ("ATM"), integrated digital services network ("ISDN"), personal communications services ("PCS"), transmission control protocol/Internet protocol ("TCP/IP"), serial line Internet protocol/point to point protocol ("SLIP/PPP"), and so on, but may also implement customized or non-standard interface protocols as well.

Software and data transferred via communication interface 590 are generally in the form of electrical communication signals 605. These signals 605 are preferably provided to communication interface 590 via a communication channel 600. In one embodiment, the communication channel 600 may be a wired or wireless network, or any variety of other communication links. Communication channel 600 carries signals 605 and can be implemented using a variety of wired or wireless communication means including wire or cable, fiber optics, conventional phone line, cellular phone link, wireless data communication link, radio frequency ("RF") link, or infrared link, just to name a few.

Computer executable code (i.e., computer programs or software) is stored in the main memory 565 and/or the secondary memory 570. Computer programs can also be received via communication interface 590 and stored in the main memory 565 and/or the secondary memory 570. Such computer programs, when executed, enable the system 550 to perform the various functions of the present invention as previously described.

In this description, the term "computer readable medium" is used to refer to any non-transitory computer readable storage media used to provide computer executable code (e.g., software and computer programs) to the system 550. Examples of these media include main memory 565, secondary memory 570 (including internal memory 575, removable medium 580, and external storage medium 595), and any peripheral device communicatively coupled with communication interface 590 (including a network information server or other network device). These non-transitory computer readable mediums are means for providing executable code, programming instructions, and software to the system 550.

In an embodiment that is implemented using software, the software may be stored on a computer readable medium and loaded into the system 550 by way of removable medium 580, I/O interface 585, or communication interface 590. In such an embodiment, the software is loaded into the system 550 in the form of electrical communication signals 605. The software, when executed by the processor 560, preferably causes the processor 560 to perform the inventive features and functions previously described herein.

The system 550 also includes optional wireless communication components that facilitate wireless communication over a voice and over a data network. The wireless communication components comprise an antenna system 610, a radio system 615 and a baseband system 620. In the system 550, radio frequency ("RF") signals are transmitted and received over the air by the antenna system 610 under the management of the radio system 615.

In one embodiment, the antenna system 610 may comprise one or more antennae and one or more multiplexors (not shown) that perform a switching function to provide the antenna system 610 with transmit and receive signal paths. In the receive path, received RF signals can be coupled from a multiplexor to a low noise amplifier (not shown) that amplifies the received RF signal and sends the amplified signal to the radio system 615.

In alternative embodiments, the radio system 615 may comprise one or more radios that are configured to communicate over various frequencies. In one embodiment, the radio system 615 may combine a demodulator (not shown) and modulator (not shown) in one integrated circuit ("IC"). The demodulator and modulator can also be separate components. In the incoming path, the demodulator strips away the RF carrier signal leaving a baseband receive audio signal, which is sent from the radio system 615 to the baseband system 620.

If the received signal contains audio information, then baseband system 620 decodes the signal and converts it to an analog signal. Then the signal is amplified and sent to a speaker. The baseband system 620 also receives analog audio signals from a microphone. These analog audio signals are converted to digital signals and encoded by the baseband system 620. The baseband system 620 also codes the digital signals for transmission and generates a baseband transmit audio signal that is routed to the modulator portion of the radio system 615. The modulator mixes the baseband transmit audio signal with an RF carrier signal generating an RF transmit signal that is routed to the antenna system and may pass through a power amplifier (not shown). The power amplifier amplifies the RF transmit signal and routes it to the antenna system 610 where the signal is switched to the antenna port for transmission.

The baseband system 620 is also communicatively coupled with the processor 560. The central processing unit 560 has access to data storage areas 565 and 570. The central processing unit 560 is preferably configured to execute instructions (i.e., computer programs or software) that can be stored in the memory 565 or the secondary memory 570. Computer programs can also be received from the baseband processor 610 and stored in the data storage area 565 or in secondary memory 570, or executed upon receipt. Such computer programs, when executed, enable the system 550 to perform the various functions of the present invention as previously described. For example, data storage areas 565 may include various software modules (not shown) that are executable by processor 560.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A trash container lid locking apparatus, comprising:

a pivot device comprising a mounting plate configured to be secured to a side edge of a trash container close to a front of the container, a pivot arm having a first end pivotally coupled to the mounting plate and a second end, the second end having an attachment portion to couple to an elongated bar which is longer than the front of the trash container, the pivot arm including a hole therein, and a housing including a rotating lock mechanism having a movable element that is operable by the rotating lock mechanism;

whereby the pivot arm is rotatable between an unlocked position in which the bar extends across the front of the container and the hinged container lid can be freely opened and closed, and a locked position in which the bar and pivot arm are pivoted upward and rearward so that the bar extends over the top of the container lid; and wherein the pivot device includes a bracket coupled to the mounting plate, the bracket includes hole therein, the bracket and the housing defining a front facing in same direction as the front of the trash container, the front including an open slot that the first pivot arm passes through;

wherein, the movable element operable with the rotating lock mechanism is configured to be positioned through the hole in the pivot arm and the hole in the bracket to lock the pivot arm in the looked position and removed from the hole in the pivot arm and the hole in the bracket to unlock the pivot arm so that the pivot arm can be moved through the open slot of the front to the unlocked position.

2. The trash container lid locking apparatus of claim 1, wherein the hole in the pivot arm is an elongated slot that the movable element of the rotating lock mechanism is positioned through to lock the pivot arm in the locked position.

3. The trash container lid locking apparatus of claim 1, wherein the housing receives and protects the movable element to prevent tampering with the movable element.

4. The trash container lid locking apparatus of claim 1, wherein the rotating lock mechanism is a key-operated cam lock mechanism.

5. The trash container lid locking apparatus of claim 1, wherein the rotating lock mechanism is combination lock.

6. The trash container lid locking apparatus of claim 5, wherein the combination lock includes a combination-controlled cam lock mechanism.

7. The trash container lid locking apparatus of claim 1, wherein the trash container lid locking apparatus is one of multiple versions that are the same except the pivot arm of each version of the multiple versions is of a different length.

8. A method of locking a trash container lid in a closed position with the trash container lid locking apparatus of claim 1, comprising:

mounting the pivot mounting plate on the side edge of the trash container adjacent to the front and an upper end opening of the trash container;

coupling the locking bar to the second end of the pivot arm;

positioning the pivot arm in the unlocked position in which the locking bar extends across the front of the container;

closing the lid of the container;

rotating the pivot arm in a direction upwards and rearwards into the locked position;

locking the pivot arm and the locking bar in the locked position in which the locking bar extends across the closed lid of the container by causing the movable element operable with the rotating lock mechanism to be positioned through the hole in the pivot arm to lock the pivot arm in the locking position.

* * * * *